US007391400B2

(12) United States Patent
Kubo et al.

(10) Patent No.: US 7,391,400 B2
(45) Date of Patent: Jun. 24, 2008

(54) LIQUID CRYSTAL DISPLAY DEVICE, DRIVING METHOD THEREOF, AND ELECTRONIC DEVICE

(75) Inventors: Masumi Kubo, Ikoma (JP); Tomoo Furukawa, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 640 days.

(21) Appl. No.: 11/084,205

(22) Filed: Mar. 21, 2005

(65) Prior Publication Data

US 2005/0219180 A1 Oct. 6, 2005

(30) Foreign Application Priority Data

Mar. 19, 2004 (JP) ..... 2004-080338

(51) Int. Cl.
*G09G 3/36* (2006.01)

(52) U.S. Cl. ..... 345/89; 345/690

(58) Field of Classification Search ..... 345/87–101, 345/690, 694
See application file for complete search history.

(56) References Cited

U.S. PATENT DOCUMENTS 6,724,452 B1 4/2004 Takeda et al.
7,038,647 B2 * 5/2006 Shigeta et al. ..... 345/89
2001/0040546 A1 11/2001 Ohmuro et al.
2002/0033789 A1 3/2002 Miyata et al.
2002/0044115 A1 4/2002 Jinda et al.
2003/0179175 A1 9/2003 Shigta et al.

FOREIGN PATENT DOCUMENTS

JP 2003-208140 7/2003

* cited by examiner

*Primary Examiner*—Amr A. Awad
*Assistant Examiner*—Dennis P Joseph
(74) *Attorney, Agent, or Firm*—Nixon & Vanderhye, P.C.

(57) ABSTRACT

A liquid crystal display device according to the present invention includes a liquid crystal panel having a vertical alignment type liquid crystal layer, and a drive circuit for supplying a driving voltage to the liquid crystal panel, and performs display in a normally black mode. At least at panel temperature 40° C., a rise transmittance Tr is equal to or greater than 75% of the transmittance in the highest gray scale level displaying state, and a decay transmittance Td is equal to or less than 8% of the transmittance in the highest gray scale level displaying state. At a panel temperature $T_1$ below 40° C., the decay transmittance Td is greater than 4% and equal to or less than 8% of the transmittance in the highest gray scale level displaying state, and when displaying an intermediate gray scale level which is higher than a gray scale level displayed in a previous vertical scanning period, the drive circuit supplies an overshoot voltage $OSV_{T1}$ which is lower than a just overshoot voltage $JOSV_{T1}$ for the panel temperature $T_1$.

44 Claims, 11 Drawing Sheets

*FIG.5*

| | | Previous Gray Scale Level | | | | | | | | |
|---|---|---|---|---|---|---|---|---|---|---|
| | | 0 | 32 | 64 | 96 | 128 | 160 | 192 | 224 | 255 |
| Current Gray Scale Level | 0 | | | | | | | | | |
| | 32 | | | | | | | | | |
| | 64 | | | | | | | | | |
| | 96 | | | | | | | | | |
| | 128 | | | | | | | | | |
| | 160 | | | | | | | | | |
| | 192 | | | | | | | | | |
| | 224 | | | | | | | | | |
| | 255 | | | | | | | | | |

0~255

0~255

LIQUID CRYSTAL DISPLAY DEVICE, DRIVING METHOD THEREOF, AND ELECTRONIC DEVICE

BACKGROUND OF THE INVENTION

1. Field of the Invention

The present invention relates to a liquid crystal display device, a driving method thereof, and an electronic device. More particularly, the present invention relates to a liquid crystal display device suitably used for the purpose of displaying moving pictures, a driving method thereof, and an electronic device incorporating such a liquid crystal display device.

2. Description of the Related Art

In recent years, liquid crystal display devices (hereinafter referred to as "LCDs") have been in wide use. The mainstream has heretofore been TN-type LCDs in which nematic liquid crystal having a positive dielectric anisotropy is employed in a twist alignment. However, TN-type LCDs have a problem in that they have a large viewing angle dependence associated with the orientation of liquid crystal molecules.

Therefore, so-called alignment-divided vertical alignment type LCDs have been developed to improve on the viewing angle dependence, and applications thereof are becoming more and more widespread. For example, Japanese Patent No. 2947350 discloses an MVA-type liquid crystal display device, which is one species of alignment-divided vertical alignment type liquid crystal display device. The MVA-type liquid crystal display device is an LCD which performs display in a normally black (NB) mode by using a vertical alignment type liquid crystal layer which is provided between a pair of electrodes. Domain restriction means (e.g., slits or protrusions) are provided so that liquid crystal molecules in each pixel will lean or incline in a plurality of different directions under an applied voltage.

Recently, there has been a rapidly increasing need to display moving picture information, not only on liquid crystal television sets, but also on PC monitors and portable terminal devices (such as mobile phones or PDAs). In order to display high-quality moving pictures on an LCD, it is necessary to reduce the response time (i.e., increase the response speed) of the liquid crystal layer, and it is a requirement that a predetermined gray scale level be reached within one vertical scanning period (typically one frame).

As for MVA-type LCDs, Japanese Patent No. 2947350 discloses, for example, that the response time between black and white can be reduced to 10 msec or less. It is also described that, by providing regions differing in distance between protrusions within each pixel to give regions with different response speeds, improvement in apparent response speed can be attained without reducing the aperture ratio (see FIGS. 107 to 110 of Japanese Patent No. 2947350, for example).

On the other hand, as a driving method for improving the response characteristics of an LCD, there is known a method (referred to as "overshoot driving") that involves applying a voltage (referred to as an "overshoot voltage") which is higher than a voltage (a predetermined gray scale voltage) corresponding to a gray scale level that needs to be displayed. By applying an overshoot voltage (hereinafter referred to as an "OS voltage"), the response characteristics in gray scale display can be improved. For example, Japanese Laid-Open Patent Publication No. 2000-231091 discloses an MVA-type LCD which operates by overshoot driving (hereinafter "OS driving").

However, through detailed study, the inventors of the present invention have found a new problem which occurs when OS driving is applied to an alignment-divided vertical alignment type LCD, such as the aforementioned MVA-type LCD. This problem will be described with reference to FIG. 11.

FIG. 11 is a graph illustrating changes in transmittance over time when OS driving is performed for an MVA-type LCD which performs display in a normally black mode. In FIG. 11, the solid line represents transmittance corresponding to a target gray scale level, whereas the dotted line and the dot-dash line show transition of the actual transmittance.

In general, there are two types of response of a liquid crystal layer: "rise" and "decay". A "rise" is a change in the display state in response to an increase in the voltage applied across the liquid crystal layer. A "decay" is a change in the display state in response to a decrease in the voltage applied across the liquid crystal layer. In an LCD of a normally black mode, "rise" corresponds to an increase in transmittance, whereas "decay" corresponds to a decrease in transmittance.

FIG. 11 illustrates a case where response occurs in the order of a decay and then a rise. As shown by the dot-dash line in FIG. 11, it is preferable that a transmittance corresponding to a target gray scale level be reached within one vertical scanning period. However, in an actual LCD, as shown by the dotted line, transmittance may not decrease to the transmittance corresponding to the target gray scale level within one vertical scanning period, during a decay response. When an OS voltage for a rise response is applied in this state, the transmittance will become higher than the transmittance corresponding to the target gray scale level, thus causing a substantial shift to the white side (hereinafter referred to as "white shift").

SUMMARY OF THE INVENTION

In order to overcome the problems described above, preferred embodiments of the present invention provide: an alignment-divided vertical alignment type liquid crystal display device which is capable of displaying high-quality moving pictures; a driving method thereof; and an electronic device incorporating such a liquid crystal display device.

The present invention is directed to a liquid crystal display device for performing display in a normally black mode, comprising: a liquid crystal panel including a plurality of pixels, each having a first electrode, a second electrode opposing the first electrode, and a vertical alignment type liquid crystal layer provided between the first electrode and the second electrode; and a drive circuit for supplying a driving voltage to the liquid crystal panel, wherein, the drive circuit is capable of, when displaying an intermediate gray scale level which is higher than a gray scale level displayed in a previous vertical scanning period, supplying to the liquid crystal panel an overshoot voltage OSV which is higher than a predetermined gray scale voltage corresponding to the intermediate gray scale level, and a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., the decay transmittance Td is greater than 4% and equal to or less than 8% of the transmittance in the highest gray scale level displaying state, and when displaying an intermediate gray scale level which is higher than a gray scale level displayed in a previous vertical scanning period, the drive circuit supplies an overshoot voltage $OSV_{T1}$ which is lower than a just overshoot voltage $JOSV_{T1}$ for the panel temperature $T_1$.

In a preferred embodiment, the overshoot voltage $OSV_{T1}$ to be supplied by the drive circuit at the panel temperature $T_1$ is equal to a just overshoot voltage $JOSV_{T2}$ for a panel temperature $T_2$ which is higher than the panel temperature $T_1$.

In a preferred embodiment, the panel temperature $T_2$ and the panel temperature $T_1$ satisfy the relationship $T_1+3 \leqq T_2 < T_1+10$.

In a preferred embodiment, the panel temperature $T_2$ and the panel temperature $T_1$ substantially satisfy the relationship $T_1+5=T_2$.

It is preferable that the overshoot voltage $OSV_{T1}$ to be supplied by the drive circuit at the panel temperature $T_1$ is prescribed so that, even if the overshoot voltage $OSV_{T1}$ is supplied when a predetermined transmittance corresponding to the gray scale level displayed in the previous vertical scanning period is not reached, the transmittance after the lapse of the time corresponding to one vertical scanning period accounts for 70% to 100% of the transmittance corresponding to the intermediate gray scale level.

In a preferred embodiment, $d^2 \cdot \gamma/\Delta V$ is prescribed to be greater than $40\times10^{-6}$ ($mm^4/(V\cdot s)$) and equal to or less than $50\times10^{-6}(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

In a preferred embodiment, $d^2 \cdot \gamma/\Delta V$ is prescribed to be greater than $18\times10^{-6}(mm^4/(V\cdot s))$ and equal to or less than $23\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

In a preferred embodiment, at a panel temperature $T_3$ which is below 40° C. and higher than the panel temperature $T_1$, the decay transmittance Td is greater than 0.5% and equal to or less than 4% of the transmittance in the highest gray scale level displaying state, and when displaying an intermediate gray scale level which is higher than a gray scale level displayed in a previous vertical scanning period, the drive circuit supplies an overshoot voltage $OSV_{T3}$ which is lower than a just overshoot voltage $JOSV_{T3}$ for the panel temperature $T_3$ if the intermediate gray scale level is equal to or less than a predetermined gray scale level, and supplies the just overshoot voltage $JOSV_{T3}$ if the intermediate gray scale level is higher than the predetermined gray scale level.

In a preferred embodiment, the predetermined gray scale level is a gray scale level equal to or less than a $64^{th}/255$ gray scale level.

In a preferred embodiment, the overshoot voltage $OSV_{T3}$ to be supplied by the drive circuit at the panel temperature $T_3$ is equal to a just overshoot voltage $JOSV_{T4}$ for a panel temperature $T_4$ which is higher than the panel temperature $T_3$.

In a preferred embodiment, the panel temperature $T_4$ and the panel temperature $T_3$ satisfy the relationship $T_3+3 \leqq T_4 < T_3+10$.

In a preferred embodiment, the panel temperature $T_4$ and the panel temperature $T_3$ substantially satisfy the relationship $T_3+5=T_4$.

It is preferable that the overshoot voltage $OSV_{T3}$ to be supplied by the drive circuit at the panel temperature $T_3$ is prescribed so that, even if the overshoot voltage $OSV_{T3}$ is supplied when a predetermined transmittance corresponding to the gray scale level displayed in the previous vertical scanning period is not reached, the transmittance after the lapse of the time corresponding to one vertical scanning period accounts for 70% to 100% of the transmittance corresponding to the intermediate gray scale level.

In a preferred embodiment, $d^2 \cdot \gamma/\Delta V$ is prescribed to be greater than $20\times10^{-6}(mm^4/(V\cdot s))$ and equal to or less than $40\times10^{-6}(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

In a preferred embodiment, $d^2 \cdot \gamma/\Delta V$ is prescribed to be greater than $7\times10^{-6}(mm^4/(V\cdot s))$ and equal to or less than $18\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

In a preferred embodiment, at a panel temperature $T_5$ which is below 40° C. and higher than the panel temperature $T_3$, the decay transmittance Td is less than 0.5% of the transmittance in the highest gray scale level displaying state, and when displaying an intermediate gray scale level which is higher than a gray scale level displayed in a previous vertical scanning period, the drive circuit supplies a just overshoot voltage $JOSV_{T5}$ for the panel temperature $T_5$.

In a preferred embodiment, $d^2 \cdot \gamma/\Delta V$ is prescribed to be equal to or less than $20\times10^{-6}(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

In a preferred embodiment, $d^2 \cdot \gamma/\Delta V$ is prescribed to be equal to or less than $7\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

Alternatively, the present invention is directed to a liquid crystal display device for performing display in a normally black mode, comprising: a liquid crystal panel including a plurality of pixels, each having a first electrode, a second electrode opposing the first electrode, and a vertical alignment type liquid crystal layer provided between the first electrode and the second electrode; and a drive circuit for supplying a driving voltage to the liquid crystal panel, wherein, the drive circuit is capable of, when displaying an intermediate gray scale level which is higher than a gray scale level displayed in a previous vertical scanning period, supplying to the liquid crystal panel an overshoot voltage OSV which is higher than a predetermined gray scale voltage corresponding to the intermediate gray scale level, and a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., the decay transmittance Td is greater than 0.5% and equal to or less than 4% of the transmittance in the highest gray scale level displaying state, and when displaying an intermediate gray scale level which is higher than a gray scale level displayed in a previous vertical scanning period, the drive circuit supplies an overshoot voltage $OSV_{T1}$ which is lower than a just overshoot voltage $JOSV_{T1}$ for the panel temperature $T_1$ if the intermediate gray scale level is equal to or less than a predetermined gray scale level, and supplies the just overshoot voltage $JOSV_{T1}$ if the intermediate gray scale level is higher than the predetermined gray scale level.

In a preferred embodiment, the predetermined gray scale level is a gray scale level equal to or less than a $64^{th}/255$ gray scale level.

It is preferable that the overshoot voltage $OSV_{T1}$ to be supplied by the drive circuit at the panel temperature $T_1$ is prescribed so that, even if the overshoot voltage $OSV_{T1}$ is supplied when a predetermined transmittance corresponding to the gray scale level displayed in the previous vertical scanning period is not reached, the transmittance after the lapse of the time corresponding to one vertical scanning period accounts for 70% to 100% of the transmittance corresponding to the intermediate gray scale level.

In a preferred embodiment, the overshoot voltage $OSV_{T1}$ to be supplied by the drive circuit at the panel temperature $T_1$ is equal to a just overshoot voltage $JOSV_{T2}$ for a panel temperature $T_2$ which is higher than the panel temperature $T_1$.

In a preferred embodiment, the panel temperature $T_2$ and the panel temperature $T_1$ satisfy the relationship $T_1+3 \leqq T_2 < T_1+10$.

In a preferred embodiment, the panel temperature $T_2$ and the panel temperature $T_1$ substantially satisfy the relationship $T_1+5=T_2$.

In a preferred embodiment, $d^2 \cdot \gamma/\Delta V$ is prescribed to be greater than $20\times10^{-6}(mm^4/(V\cdot s))$ and equal to or less than $40\times10^{-6}(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

In a preferred embodiment, $d^2 \cdot \gamma/\Delta V$ is prescribed to be greater than $7\times10^{-6}(mm^4/(V\cdot s))$ and equal to or less than $18\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

In a preferred embodiment, at a panel temperature $T_3$ which is below 40° C. and higher than the panel temperature $T_1$, the decay transmittance Td is less than 0.5% of the transmittance in the highest gray scale level displaying state, and when displaying an intermediate gray scale level which is higher than a gray scale level displayed in a previous vertical scanning period, the drive circuit supplies a just overshoot voltage $JOSV_{T3}$ for the panel temperature $T_3$.

In a preferred embodiment, $d^2 \cdot \gamma/\Delta V$ is prescribed to be equal to or less than $20\times10^{-6}(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

In a preferred embodiment, $d^2 \cdot \gamma/\Delta V$ is prescribed to be equal to or less than $7\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

Alternatively, the present invention is directed to a liquid crystal display device for performing display in a normally black mode, comprising: a liquid crystal panel including a plurality of pixels, each having a first electrode, a second electrode opposing the first electrode, and a vertical alignment type liquid crystal layer provided between the first electrode and the second electrode; and a drive circuit for supplying a driving voltage to the liquid crystal panel, wherein, the drive circuit is capable of, when displaying an intermediate gray scale level which is higher than a gray scale level displayed in a previous vertical scanning period, supplying to the liquid crystal panel an overshoot voltage OSV which is higher than a predetermined gray scale voltage corresponding to the intermediate gray scale level, and a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., the decay transmittance. Td is equal to or less than 0.5% of the transmittance in the highest gray scale level displaying state, and when displaying an intermediate gray scale level which is higher than a gray scale level displayed in a previous vertical scanning period, the drive circuit supplies a just overshoot voltage $JOSV_{T1}$ for the panel temperature $T_1$.

In a preferred embodiment, $d^2 \cdot \gamma/\Delta V$ is prescribed to be equal to or less than $20\times^{10-6}(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

In a preferred embodiment, $d^2 \cdot \gamma/\Delta V$ is prescribed to be equal to or less than $7\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

The present invention is also directed to an electronic device comprising any of the aforementioned liquid crystal display devices.

In a preferred embodiment, the electronic device further comprises circuitry for receiving television broadcasts.

The present invention is also directed to a method of driving a liquid crystal display device for performing display in a normally black mode, the liquid crystal display device including a plurality of pixels each having a first electrode, a second electrode opposing the first electrode, and a vertical alignment type liquid crystal layer provided between the first electrode and the second electrode, wherein a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, the driving method comprising: an OSV applying step of, when displaying an intermediate gray scale level which is higher than a gray scale level displayed in a previous vertical scanning period, applying an overshoot voltage OSV which is higher than a predetermined gray scale voltage corresponding to the intermediate gray scale level, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., if the decay transmittance Td is greater than 4% and equal to or less than 8% of the transmittance in the highest gray scale level displaying state, an overshoot voltage $OSV_{T1}$ which is lower than a just overshoot voltage $JOSV_{T1}$ for the panel temperature $T_1$ is applied in the OSV applying step.

In a preferred embodiment, at a panel temperature $T_2$ which is below 40° C. and higher than the panel temperature $T_1$, if the decay transmittance Td is greater than 0.5% and equal to or less than 4% of the transmittance in the highest gray scale level displaying state, an overshoot voltage $OSV_{T2}$ which is lower than a just overshoot voltage $JOSV_{T2}$ for the panel temperature $T_2$ is applied in the OSV applying step if the intermediate gray scale level is equal to or less than a predetermined gray scale level, and the just overshoot voltage $JOSV_{T2}$ is applied in the OSV applying step if the intermediate gray scale level is higher than the predetermined gray scale level.

In a preferred embodiment, at a panel temperature $T_3$ which is below 40° C. and higher than the panel temperature $T_2$, if the decay transmittance Td is less than 0.5% of the transmittance in the highest gray scale level displaying state, a just overshoot voltage $JOSV_{T3}$ for the panel temperature $T_3$ is applied in the OSV applying step.

Alternatively, the present invention is directed to a method of driving a liquid crystal display device for performing display in a normally black mode, the liquid crystal display device including a plurality of pixels each having a first electrode, a second electrode opposing the first electrode, and a vertical alignment type liquid crystal layer provided between the first electrode and the second electrode, wherein a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, the driving method comprising: an OSV applying step of, when displaying an intermediate gray scale level which is higher than a gray scale level displayed in a previous vertical scanning period, applying an overshoot voltage OSV which is higher than a predetermined gray scale voltage corresponding to the intermediate gray scale level, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., if the decay transmittance Td is greater than 0.5% and equal to or less than 4% of the transmittance in the highest gray scale level displaying state, an overshoot voltage $OSV_{T1}$ which is lower than a just overshoot voltage $JOSV_{T1}$ for the panel temperature $T_1$ is applied in the OSV applying step if the intermediate gray scale level is equal to or less than a predetermined gray scale level, and the just overshoot voltage $JOSV_{T1}$ is applied in the OSV applying step if the intermediate gray scale level is higher than the predetermined gray scale level.

In a preferred embodiment, at a panel temperature $T_2$ which is below 40° C. and higher than the panel temperature $T_1$, if the decay transmittance Td is less than 0.5% of the transmittance in the highest gray scale level displaying state, a just overshoot voltage $JOSV_{T2}$ for the panel temperature $T_2$ is applied in the OSV applying step.

Alternatively, the present invention is directed to a method of driving a liquid crystal display device for performing display in a normally black mode, the liquid crystal display device including a plurality of pixels each having a first electrode, a second electrode opposing the first electrode, and a vertical alignment type liquid crystal layer provided between the first electrode and the second electrode, wherein a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, the driving method comprising: an OSV applying step of, when displaying an intermediate gray scale level which is higher than a gray scale level displayed in a previous vertical scanning period, applying an overshoot voltage OSV which is higher than a predetermined gray scale voltage corresponding to the intermediate gray scale level, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., if the decay transmittance Td is equal to or less than 0.5% of the transmittance in the highest gray scale level displaying state, a just overshoot voltage $JOSV_{T1}$ for the panel temperature $T_1$ is applied in the OSV applying step.

According to the present invention, it is possible to obtain a sufficient improvement in response speed while suppressing the occurrence of a white shift when overshoot driving is applied to an alignment-divided vertical alignment type liquid crystal display device. Thus, according to the present invention, an alignment-divided vertical alignment type liquid crystal display device which is capable of displaying high-quality moving pictures, and a driving method thereof, are provided.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 5 is a diagram schematically showing a look-up table to be stored in a look-up table memory of the drive circuit.

DETAILED DESCRIPTION OF PREFERRED EMBODIMENTS

Figure 1A:
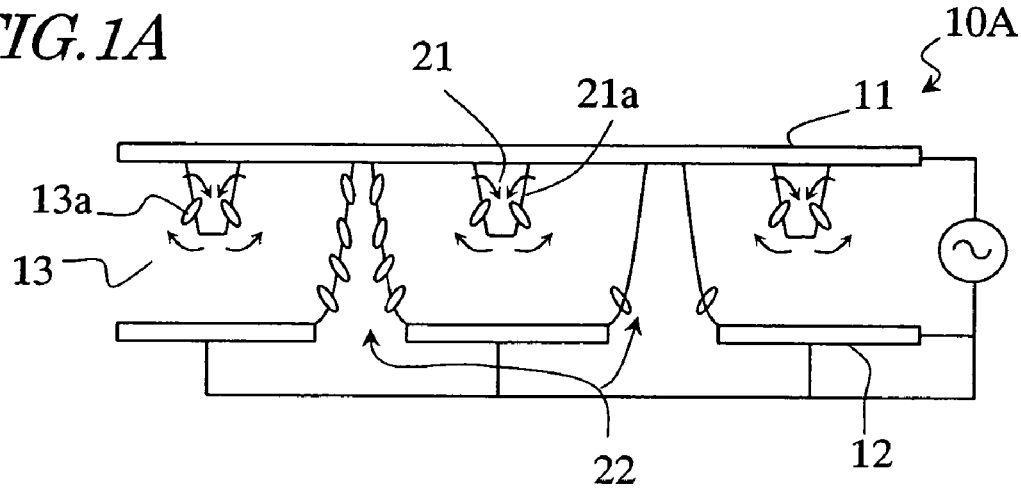
FIGS. 1A to 1C are cross-sectional views schematically showing an exemplary basic structure of a liquid crystal panel comprised in an LCD of the present invention.

Hereinafter, an LCD according to an embodiment of the present invention and a driving method thereof will be described with reference to the accompanying drawings.

An alignment-divided vertical alignment type LCD according to the present invention, which includes a liquid crystal panel having a vertical alignment type liquid crystal layer and a drive circuit for supplying a driving voltage to the liquid crystal panel, performs display in a normally black mode.

First, the basic structure of the liquid crystal panel will be described with reference to FIGS. 1A to 1C.

The liquid crystal panel of the present embodiment comprises a plurality of pixels, each including: a first electrode 11; a second electrode 12 opposing the first electrode 11; and a vertical alignment type liquid crystal layer 13 provided between the first electrode 11 and the second electrode 12. In the vertical alignment type liquid crystal layer 13, liquid crystal molecules having a negative dielectric anisotropy are aligned in a direction substantially perpendicular (e.g., equal to or greater than 87° and equal to or less than 90°) to the planes of the first electrode 11 and the second electrode 12, in the absence of an applied voltage. Typically, such a liquid crystal layer is obtained by providing a vertical alignment film (not shown) on a face of each of the first electrode 11 and the second electrode 12 facing the liquid crystal layer 13. In the case where ribs (protrusions) or the like are provided as orientation restriction means, the liquid crystal molecules will be oriented substantially perpendicularly to a face of the ribs or the like facing the liquid crystal layer.

At the first electrode 11 side of the liquid crystal layer 13 is provided first orientation restriction means (21, 31, or 41). At the second electrode 12 side of the liquid crystal layer 11 is provided second orientation restriction means (22, 32, or 42). In each liquid crystal region defined between the first orientation restriction means and the second orientation restriction means, the liquid crystal molecules 13*a* receive orientation restriction force from the first orientation restriction means and the second orientation restriction means. When a voltage is applied between the first electrode 11 and the second electrode 12, the liquid crystal molecules 13*a* lean or incline in directions shown by arrows in FIGS. 1A to 1C. In other words, the liquid crystal molecules will lean in a uniform direction in each liquid crystal region; thus, each liquid crystal region can be regarded as a domain. The "orientation restriction means" as recited in the present specification correspond to the domain restriction means described in Japanese Patent No. 2947350 and Japanese Laid-Open Patent Publication No. 2000-231091, supra.

The first orientation restriction means and the second orientation restriction means (which may simply be referred to as "orientation restriction means" collectively) are provided in the form of strips in each pixel. FIGS. 1A to 1C are cross-sectional views taken along a direction perpendicular to a direction in which the strip-like orientation restriction means extend. Liquid crystal regions (domains) are formed with respect to each orientation restriction means, one on each side of the orientation restriction means, such that the direction in which the liquid crystal molecules 13*a* lean differs by 180° in these regions.

The liquid crystal panel 10A shown in FIG. 1A includes ribs 21 as the first orientation restriction means, and includes slits (openings) 22, which are provided in the second electrode 12, as the second orientation restriction means. The ribs 21 and the slits 22 are provided so as to extend in the form of strips or belts. The ribs 21 cause the liquid crystal molecules 13*a* to orient in a direction substantially perpendicular to side faces 21*a* thereof, whereby the liquid crystal molecules 13*a* align in a direction perpendicular to the direction in which the ribs 21 extend. The slits 22 act so that, when a potential difference is formed between the first electrode 11 and the second electrode 12, an oblique electric field is generated in a portion of the liquid crystal layer 13 lying near an end of each slit 22, whereby the liquid crystal molecules 13*a* align in a direction perpendicular to the direction in which the slits 22 extend. The ribs 21/slits 22 are disposed at a predetermined interval so as to be parallel to one another, such that a liquid crystal region (domain) is formed between each adjoining pair of ribs 21/slits 22.

Figure 1B:
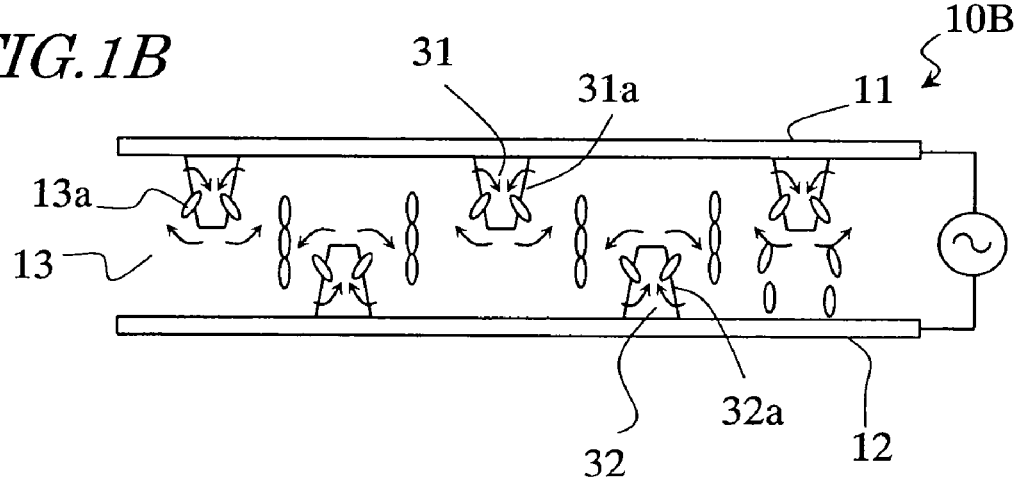

The liquid crystal panel 10B shown in FIG. 1B differs from the liquid crystal panel 10A of FIG. 1A in that ribs 31 and ribs 32 are provided as the first orientation restriction means and the second orientation restriction means, respectively. The ribs 31/ribs 32 are disposed at a predetermined interval so as to be parallel to one another. The ribs 31 and ribs 32 cause the liquid crystal molecules 13*a* to orient in a direction substantially perpendicular to side faces 31*a* of the ribs 31 and side faces 32*a* of the ribs 32, such that liquid crystal regions (domains) are formed between them.

Figure 1C:
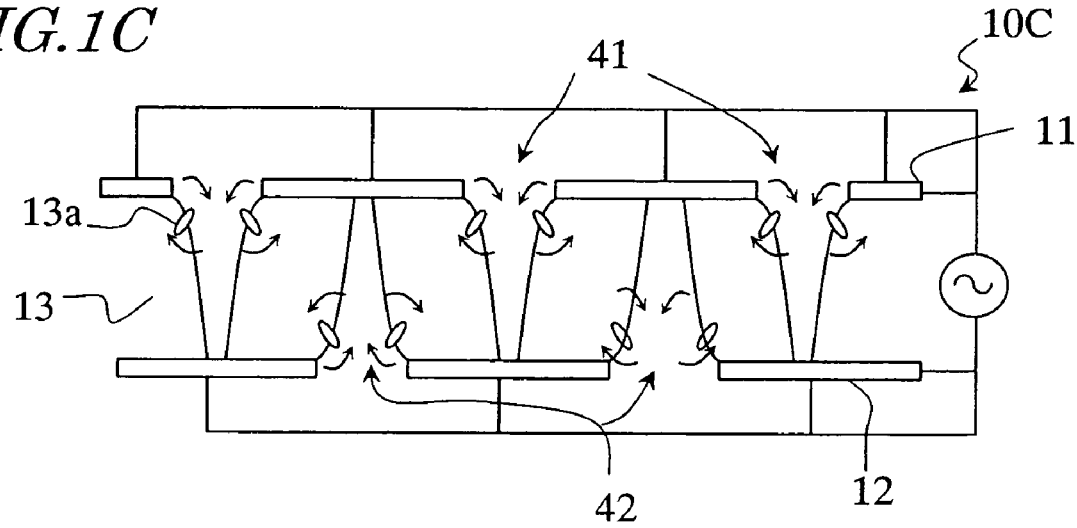

The liquid crystal panel 10C shown in FIG. 1C differs from the liquid crystal panel 10A of FIG. 1A in that slits 41 and slits 42 are provided as the first orientation restriction means and the second orientation restriction means, respectively. The slits 41 and the slits 42 act so that, when a potential difference is formed between the first electrode 11 and the second electrode 12, an oblique electric field is generated in a portion of the liquid crystal layer 13 lying near an end of each slit 41 or 42, whereby the liquid crystal molecules 13*a* align in a direction perpendicular to the direction in which the slits 41 and 42 extend. The slits 41/slits 42 are disposed at a predetermined interval so as to be parallel to one another, such that a liquid crystal region (domain) is formed therebetween.

Thus, any arbitrary combination of ribs and/or slits may be used as the first orientation restriction means and the second orientation restriction means. The first electrode 11 and the second electrode 12 only need to be electrodes which oppose each other with the liquid crystal layer 13 interposed therebetween; typically, one of the electrodes 12 and 13 constitutes a counter electrode, whereas the other is one of a plurality of pixel electrodes. Hereinafter, an embodiment of the present invention will be described in which the first electrode 11 is a counter electrode and the second electrodes 12 are pixel electrodes, with respect to an exemplary liquid crystal panel (corresponding to the liquid crystal panel 10A shown in FIG. 1A), having ribs 11 as the first orientation restriction means and having slits 22, which are provided in the pixel electrodes, as the second orientation restriction means. When the structure of the liquid crystal panel 10A as shown in FIG. 1A is adopted, there is an advantage of being able to minimize the increase in the number of production steps. Introduction of slits in the pixel electrodes does not require any additional production steps. As for the counter electrode, ribs would require a smaller increase in the number of production steps than slits. It will be appreciated that the present invention is also applicable to any structure in which only ribs or only slits are used as orientation restriction means.

Figure 2:
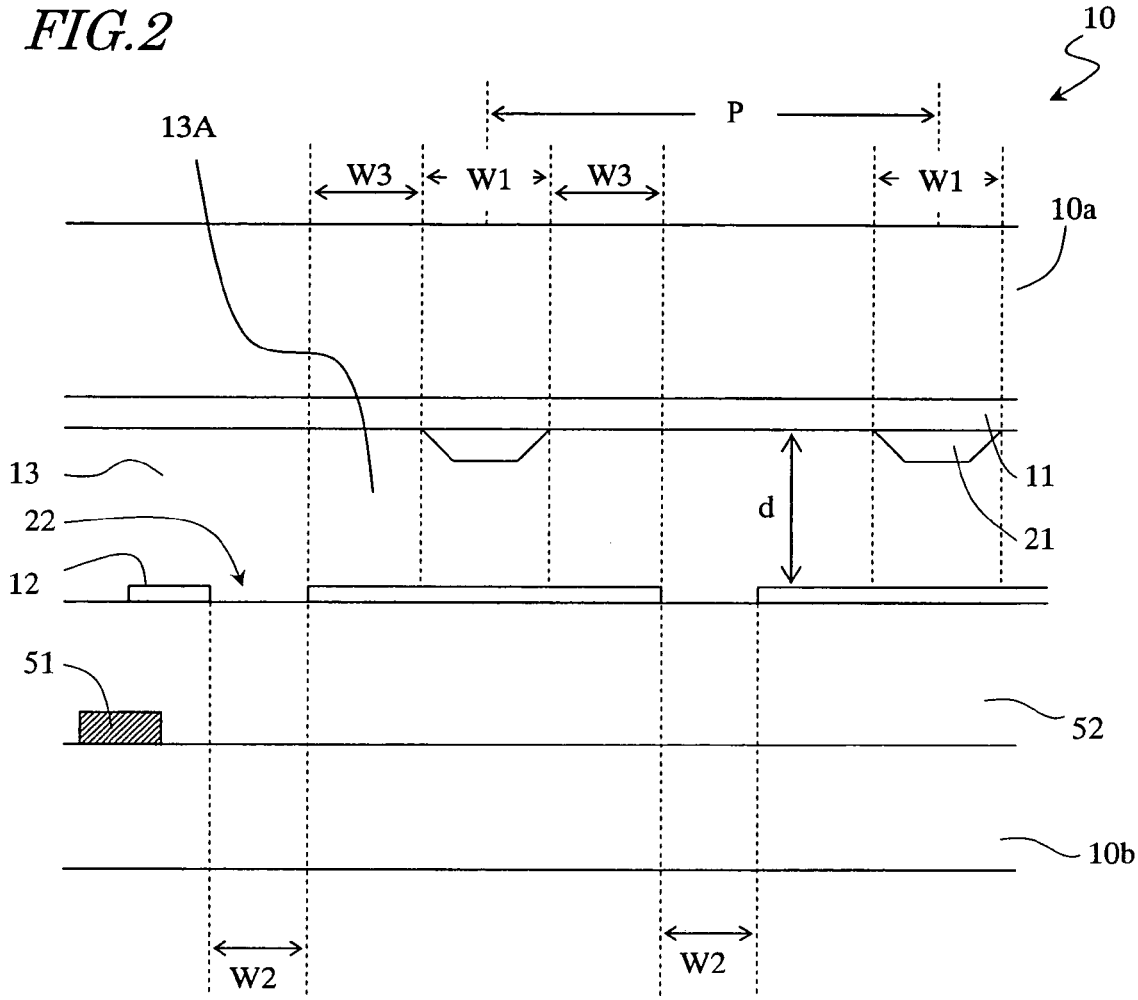
FIG. 2 is a partial cross-sectional view schematically showing a cross-sectional structure of a liquid crystal panel comprised in an LCD of the present invention.
Figure 3:
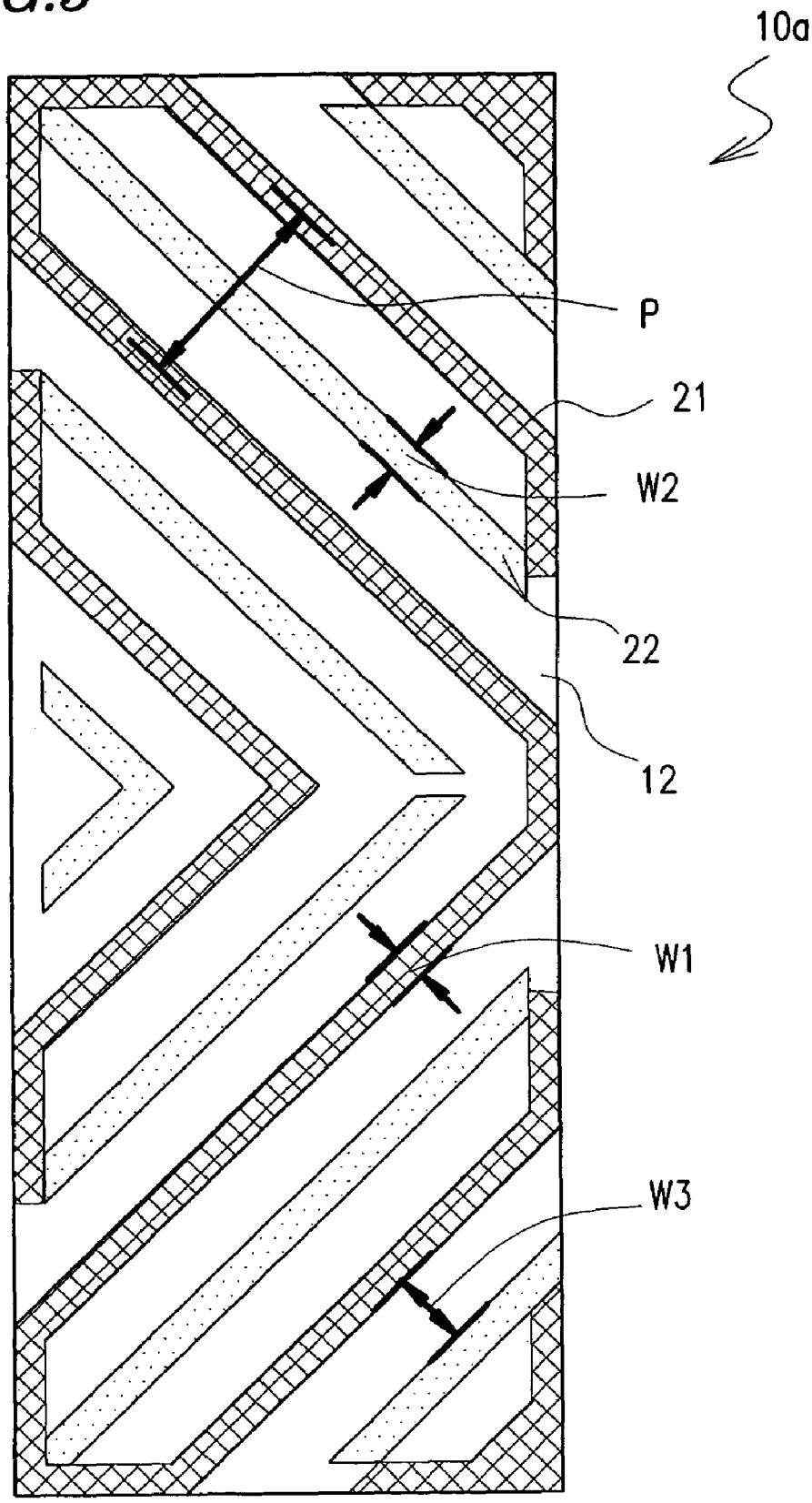
FIG. 3 is a schematic plan view showing a pixel portion of a liquid crystal panel comprised in an LCD of the present invention.

Referring to FIGS. 2 and 3, the structure of the liquid crystal panel 10 of the present embodiment will be described more specifically. FIG. 2 is a partial cross-sectional view schematically showing a cross-sectional structure of the liquid crystal panel 10. FIG. 3 is a plan view showing a pixel portion 10*a* of the liquid crystal panel 10. The liquid crystal panel 10 has the same basic structure as that of the liquid crystal panel 10A of FIG. 1A. Therefore, like elements are denoted by like reference numerals.

The liquid crystal panel 10 includes a vertical alignment type liquid crystal layer 13 interposed between a first substrate (e.g., a glass substrate) 10*a* and a second substrate (e.g., a glass substrate) 10*b*. On a face of the first substrate 10*a* facing the liquid crystal layer 13, a counter electrode 11 is provided, upon which ribs 21 are formed. Over substantially the entire face (including the ribs 21) of the counter electrode 11 facing the liquid crystal layer 13, a vertical alignment film (not shown) is provided. The ribs 21 are provided in the form of strips as shown in FIG. 3. Adjoining ribs 21 extend in parallel to each other, with a constant interval (pitch) P. The width W1 of the ribs 21 (i.e., a width taken along a direction perpendicular to the direction in which the ribs 21 extend) is also constant.

On the face of the second substrate (e.g., a glass substrate) 10*b* facing the liquid crystal layer 13, a gate bus line (scanning line), a source bus line (signal line) 51, and a TFT (not shown) are provided, and an interlayer insulating film 52 is formed so as to cover these elements. A pixel electrode 12 is formed upon the interlayer insulating film 52. In this example, a transparent resin film having a thickness which is no less than 1.5 μm and no more than 3.5 μm is used to compose the interlayer insulating film 52 having a flat surface. This makes it possible to dispose the pixel electrode 12 so as to partially overlay the gate bus line and/or the source bus line, whereby an improved aperture ratio can be provided.

Strip-like slits 22 are formed in the pixel electrode 12. Over substantially the entire face (including the slits 22) of the pixel electrode 12, a vertical alignment film (not shown) is provided. As shown in FIG. 3, the slits 22 are formed in the form of strips. Any adjoining slits 22 are disposed in parallel to each other. Each slit 21 is disposed in a position to substantially bisect the interval between adjoining ribs 21. The slits 22 have a constant width W2 along a direction perpendicular to the direction in which the slits 22 extend. The shapes and positions of the slits and/or ribs may deviate from design values, due to factors such as diversifications during the production process, positioning tolerances when attaching the substrates together, and the like; it is intended that any such deviation be accommodated within the generic descriptions set forth above.

Between each strip-like, parallel pair of rib 21 and slit 22, a strip-like liquid crystal region 13A having a width W3 is defined. Each liquid crystal region 13A has its orientation direction restricted by the rib 21 and slit 22 which define the liquid crystal region 13A. As a result, liquid crystal regions (domains) are formed on both sides of each rib 21 or slit 22, such that the direction in which the liquid crystal molecules 13*a* lean differs by 180° in any two such regions. In the liquid crystal panel 10, as shown in FIG. 3, the ribs 21 and slits 22 are disposed so as to extend in either of two directions differing by 90°. Thus, each pixel portion 10*a* includes four types of liquid crystal regions 13A, in which the orientation direction of the liquid crystal molecules 13*a* differs by 90° from region to region. Such an arrangement of the ribs 21 and slits 22 makes for good viewing angle characteristics, although the present invention is not limited thereto.

On opposing sides of the first and second substrates 10*a* and 10*b*, a pair of polarizers (not shown) is provided, with their transmission axes being substantially perpendicular to each other (crossed Nicol state). The retardation variation obtained through the liquid crystal region 13A can be most efficiently utilized by disposing the polarizers in such a manner that, in every one of the four types of liquid crystal regions 13A whose orientation directions vary by 90° from one another, the liquid crystal molecule orientation direction constitutes an angle of 45° with respect to each of the polarizer transmission axes. In other words, it is preferable that the transmission axes of the polarizers constitute an angle of about 45° with the directions along which the ribs 21 and slits 22 extend. In the case of a display device whose viewing direction is likely to be moved in a horizontal direction with respect to the display surface (e.g., a television set), it is preferable to place the transmission axis of one of the pair of polarizers in a horizontal direction with respect to the display surface, in order to minimize the viewing angle dependence of display quality.

Figure 4:
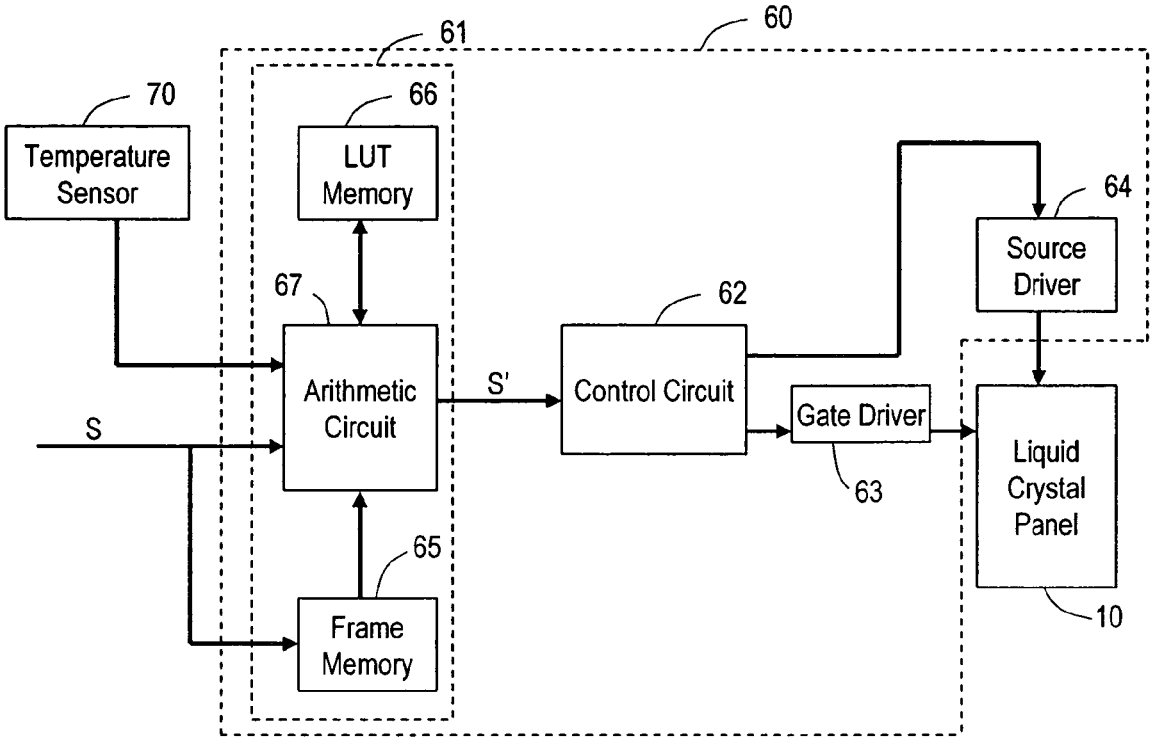
FIG. 4 is a block diagram schematically showing a drive circuit comprised in an LCD of the present invention.

Next, referring to FIG. 4, a drive circuit 60 comprised in an LCD of the present invention will be described.

The drive circuit 60 receives an input image signal S from the outside, and supplies to the liquid crystal panel 10 a driving voltage which is in accordance with the input image signal S. The drive circuit 60 is capable of performing overshoot driving (also referred to as "overdrive driving"). In other words, when displaying any intermediate gray scale level which is higher than a gray scale level that was displayed in a previous vertical scanning period, the drive circuit 60 is capable of supplying to the liquid crystal panel 10 a voltage (referred to as an "overshoot voltage (OS voltage)") which is higher than a predetermined gray scale voltage corresponding to that intermediate gray scale level. Hereinafter, the structure of the drive circuit 60 will be more specifically described.

The drive circuit 60 includes a signal conversion section 61, a control circuit 62, a gate driver 63, and a source driver 64.

The signal conversion section 61 receives the input image signal S from the outside, and converts it to a signal S' for performing overshoot driving. Based on the output signal S' from the signal conversion section 61, the control circuit 62 sends a control signal to the gate driver 63 and the source driver 64. The gate driver 63, which is connected to gate wiring of the liquid crystal panel 10, supplies to each TFT gate electrode a gate voltage which is in accordance with the control signal received from the control circuit 62. The source driver 64, which is connected to source wiring of the liquid crystal panel 10, supplies to each TFT source electrode a source voltage which is in accordance with the control signal received from the control circuit 62.

The signal conversion section 61 of the present embodiment includes a frame memory 65, a look-up table (LUT) memory 66, and an arithmetic circuit 67. The frame memory 65 retains an image corresponding to at least one vertical scanning period of the input image signal S. In other words, in the case of interlace driving (in which one frame is divided into a plurality of fields), the frame memory 65 retains at least one field image; in the case of a non-interlace driving (in which one frame is not divided into a plurality of fields), the frame memory 65 retains at least one frame image.

The LUT memory 66 stores at least one look-up table which is to be selected depending on the panel temperature. The look-up table has a two-dimensional matrix structure of 9 rows×9 columns as shown in FIG. 5, for example. From the combination of a gray scale level corresponding to the input image signal S in a current vertical scanning period and a gray scale level corresponding to the input image signal S in a previous vertical scanning period, a single OS gray scale level (0 to 255) is determined. As used herein, an "OS gray scale level" is a gray scale expression of the magnitude (level) of OS voltage. For example, when it is said that "the OS gray scale level is 128", it is meant that a voltage of the same magnitude (level) as that of a gray scale voltage corresponding to the $128^{th}$ gray scale level is to be applied as an OS voltage. Throughout the present specification, a complete set of such OS gray scale levels with respect to a given panel temperature, each of which is to be determined in accordance with a combination of a current gray scale level and a previous gray scale level, will be referred to as an "OS parameter".

The arithmetic circuit 67 compares the input image signal S in the current vertical scanning period and the input image signal S from the previous vertical scanning period as retained in the frame memory, selects from among the LUT(s) stored in the LUT memory 66 a LUT associated with the closest temperature to the panel temperature as detected by a temperature sensor 70, and generates the signal S' for OS driving by referring to the selected LUT. Note that the look-up table exemplified in FIG. 5 only describes combinations of every 32 gray scale levels, rather than describing all possible combinations of gray scale levels; in other words, this exemplary look-up table only describes a portion of the OS parameter. The arithmetic circuit 67 generates any OS gray scale level that corresponds to a combination which is not described in the look-up table, by performing an interpolation from the described combinations. By thus reducing the number of combinations described in each LUT, the required capacity of the LUT memory 66 can be reduced. It will be appreciated, on the other hand, that a LUT(s) having a 256 rows×256 columns matrix structure that describes all possible combinations of gray scale levels may instead be prepared.

Figure 11:
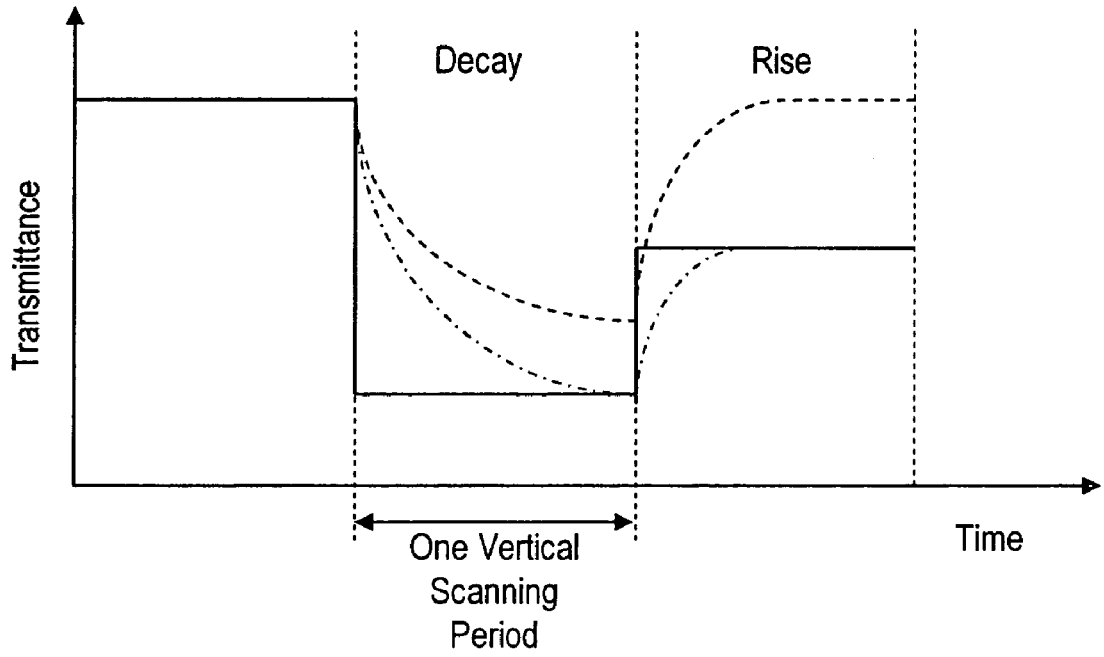
FIG. 11 is a graph for explaining a problem occurring when OS driving is performed for a conventional MVA-type LCD.

The LCD of the present invention is constructed so that the liquid crystal panel 10 has an alignment-divided structure as described above, and therefore is capable of performing display with excellent viewing angle characteristics. Since the LCD of the present invention includes the drive circuit 60 which is capable of OS driving, excellent response characteristics are provided. In accordance with the LCD of the present invention, furthermore, the OS parameter is prescribed to a predetermined set of values in accordance with the response characteristics of the liquid crystal layer. As a result, occurrence of white shift as illustrated in FIG. 11 is suppressed. Hereinafter, a manner of setting an OS parameter for the LCD of the present invention will be described.

Firstly, an LCD of the present invention is characterized in that a rise transmittance Tr, which is defined as the transmittance when a time corresponding to one vertical scanning period has elapsed since a voltage corresponding to a highest gray scale level is applied in a black display state, and a decay transmittance Td, which is defined as the transmittance when a time corresponding to one vertical scanning period has elapsed since a voltage corresponding to a black display state is applied in a highest gray scale level displaying state, are prescribed as follows: at least at a panel temperature of 40° C., a ratio (hereinafter referred to as a "rise achievement ratio") of the rise transmittance Tr to the transmittance in the highest gray scale level displaying state is equal to or greater than 75%, and a ratio (hereinafter referred to as a "decay achievement ratio") of the decay transmittance Td to the transmittance in the highest gray scale level displaying state is equal to or less than 8%.

First, the reason why the rise achievement ratio should be equal to or greater than 75% is described.

In order to perform satisfactory display during OS driving, it is preferable that continuity of the OS parameter is maintained. In other words, in any gray scale level transition (corresponding to a single row in a LUT) from a given gray scale level, it is preferable that the OS gray scale level varies continuously with changes in the target gray scale level.

A "transmittance corresponding to 75% of the transmittance in the highest gray scale level displaying state" would correspond to the $224^{th}$ gray scale level in a case where gray scale display is performed from the $0^{th}$ gray scale level (black) to the $255^{th}$ gray scale level (white) at $\gamma^{2.2}$. Therefore, if the rise achievement ratio were less than 75%, when attempting a transition from the $0^{th}$ gray scale level to the $224^{th}$ gray scale level, it would not be possible to reach the transmittance corresponding to the $224^{th}$ gray scale level within one vertical scanning period, even by applying the highest gray scale voltage (OS gray scale level=255) as the OS voltage. In other words, the OS gray scale level would have to be universally set at 255 for any target gray scale level that goes beyond a certain gray scale level which is somewhere below the $224^{th}$ gray scale level, all the way up to the $255^{th}$ gray scale level; as a result, OS parameter continuity from that certain gray scale level onwards is lost, all the way up to the $255^{th}$ gray scale level. On the other hand, when the rise achievement ratio is equal to or greater than 75%, OS parameter continuity is maintained at least in the range from the $0^{th}$ gray scale level to the $224^{th}$ gray scale level, so that display can be performed without problems.

Figure 6:
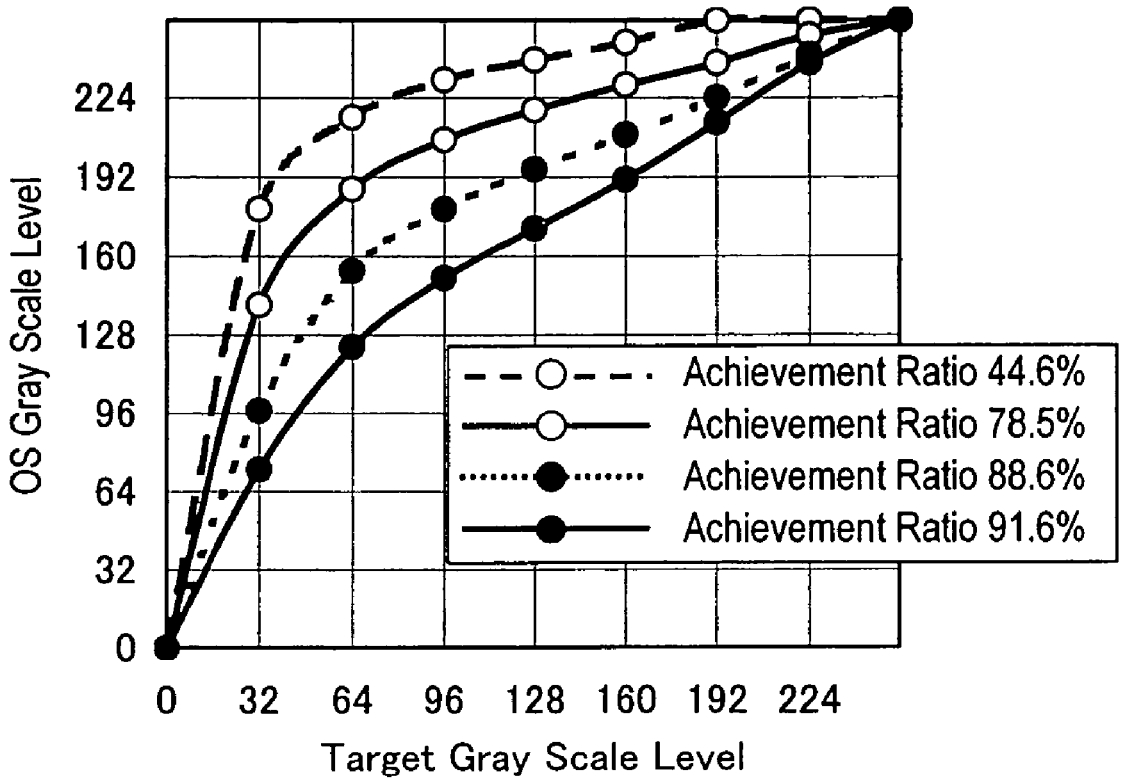
FIG. 6 is a graph showing relationships between target gray scale levels and OS gray scale levels when a transition from the $0^{th}$ gray scale level to a predetermined target gray scale level is to be caused.

FIG. 6 is a graph showing relationships between target gray scale levels and OS gray scale levels when a transition from the $0^{th}$ gray scale level to a predetermined target gray scale level is to be caused, with respect to the cases where the rise achievement ratio is 44.6%, 78.5%, 88.6%, and 91.6%. In FIG. 6, an LCD having certain cell parameters was tentatively produced, and its rise achievement ratio was varied by allowing the panel temperature to vary. As shown in FIG. 6, the OS gray scale level undergoes continuous changes in the cases where the rise achievement ratio is 78.5%, 88.6%, and 91.6%. On the other hand, in the case where the rise achievement ratio is 44.6%, the OS gray scale level is saturated at any gray scale level equal to or greater than the $192^{th}$ gray scale level, that is, OS parameter continuity is lost.

Next, the reason why the decay achievement ratio should be equal to or less than 8% is described.

The inventors have found through experimentation that, if the decay achievement ratio exceeds 8%, it is impossible to attain a sufficient improvement in response speed while suppressing white shift, irrespective of what sort of OS parameter is set.

First, the inventors have performed subjective evaluations of display quality for an LCD having a rise achievement ratio equal to or greater than 75%, while varying the decay achievement ratio and using various OS parameters.

In order to arrive at qualitative expressions of the OS parameter, a reference OS parameter must first be established. Specifically, a "just overshoot voltage" is defined herein as an OS voltage such that, when the transmittance of an LCD is at a transmittance corresponding to a target gray scale level in a previous vertical scanning period, the application of the OS voltage will cause the transmittance to reach a transmittance corresponding to a target gray scale level in a current vertical scanning period, within a time corresponding to one vertical scanning period. Furthermore, a "just parameter" is defined as an OS parameter corresponding to a set composed only of just overshoot voltages. Hereinafter, a just overshoot voltage at a panel temperature T(° C.) will be expressed as $JOSV_T$. Moreover, any OS parameter containing an overshoot voltage(s) lower than the just overshoot voltage will be referred to as an OS parameter which is "weaker" than the just parameter. Generally, the response characteristics of a liquid crystal layer become more enhanced as the temperature increases; that is, lower just overshoot voltages can be used as the temperature increases. Therefore, as compared to a just parameter for a given panel temperature, a just parameter for any panel temperature higher than that panel temperature is considered a "weak" OS parameter.

Table 1 shows results of the subjective evaluations. In these subjective evaluations, the following OS parameters were used: a just parameter for a certain panel temperature; a just parameter for a panel temperature which is 5° C. higher than the certain panel temperature (denoted as "+5° C. just parameter"); a just parameter for a panel temperature which is 10° C. higher than the certain panel temperature (denoted as "+10° C. just parameter"); and a just parameter for a panel temperature which is 15° C. higher than the certain panel temperature (denoted as "+15° C. just parameter"). Also used was an OS parameter which combines the just parameter (applied for gray scale levels exceeding the $64^{th}$ gray scale level) and the +5° C. just parameter (applied for the $64^{th}$ and lower gray scale levels).

TABLE 1

| Decay achievement ratio | Just parameter | +5° C. (≦64 gsl) Just (>64 gsl) | +5° C. just parameter | +10° C. just parameter | +15° C. just parameter |
|---|---|---|---|---|---|
| | ◎ | | | | |
| | | border 0.5% | | | |
| 1% | X | ◎ | ○ | | ○ |
| 3.5% | X | ◎ | ○ | | ○ |
| | | border 4% | | | |
| 6% | X | X | ◎ | ○ | ○ |
| 7% | X | X | ◎ | ○ | ○ |
| | | border 8% | | | |
| 9% | X | X | X | Δ | Δ |

Symbols used in Table 1 represent the results described below. The response speed evaluations were made by using video images which contained a still image output from TG35 (ShibaSoku Co., Ltd) being scrolled in the lateral direction at 7 pixels/field.

◎: White shift is suppressed, and response speed is sufficient.

○: White shift is suppressed, but response speed is slightly slower than ◎.

Δ: White shift is suppressed, but response speed is slow.

X : White shift occurs.

As can be seen from Table 1, when the decay achievement ratio was over 8%, good results (◎, ○) were not obtained no matter how the OS parameter was changed. On the other hand, when the decay achievement ratio was 8% or less, good results (◎, ○) were obtained under certain OS parameters. Hereinafter, OS parameters for obtaining good results will be discussed.

First, when the decay achievement ratio was over 4% but 8% or less, good results were obtained by using weaker OS parameters than the just parameters, as seen from Table 1. In other words, at a given panel temperature $T_1$ below 40° C., the drive circuit 60 functions to supply an overshoot voltage $OSV_{T1}$ which is lower than the just overshoot voltage $JOSV_{T1}$ for that panel temperature $T_1$, thus providing a sufficient response speed while suppressing white shift.

As an OS parameter weaker than the just parameter for the panel temperature $T_1$, a just parameter for a panel temperature $T_2$ which is higher than $T_1$ can be used, as exemplified in Table 1. In other words, as an overshoot voltage $OSV_{T1}$ to be supplied by the drive circuit 60 at the panel temperature $T_1$, a just overshoot voltage $JOSV_{T2}$ for a panel temperature $T_2$ which is higher than $T_1$ can be used.

From the standpoint of sufficiently suppressing white shift, it is preferable that the OS parameter is adequately weak (i.e., the OS voltage should be adequately low). From the standpoint of sufficiently improving the response speed, it is preferable that the OS parameter is not too weak (i.e., the OS voltage should not be too low).

Specifically, it is preferable to prescribe the overshoot voltage $OSV_{T1}$ to be supplied by the drive circuit 60 at the panel temperature $T_1$ so that, even if the overshoot voltage $OSV_{T1}$ is supplied when a predetermined transmittance corresponding to the gray scale level displayed in a previous vertical scanning period is not reached, the transmittance after the lapse of a time corresponding to one vertical scanning period accounts for 70% to 100%, more preferably 75% to 100%, and still more preferably 80% to 100%, of the transmittance corresponding to the target gray scale level. By prescribing such an overshoot voltage $OSV_{T1}$, it is possible to enhance both effects of white shift suppression and response speed improvement.

More specifically, by using a just parameter for a panel temperature $T_2$ which satisfies the relationship $T_1+3 \leqq T_2 < T_1+10$, it becomes possible to enhance both effects of white shift suppression and response speed improvement. For example, as exemplified in Table 1, a just parameter for a panel temperature $T_2$ which is about 5° C. higher than $T_1$ ($T_1+5=T_2$) can be used.

In the case where the decay achievement ratio is over 0.5% but 4% or less, as seen from Table 1, good results can be obtained by using an OS parameter which is weaker than the just parameter for some gray scale levels (towards the lower gray scale levels) and using the just parameter for the other gray scale levels (towards the higher gray scale levels). In other words, at a given panel temperature $T_1$ below 40° C., the drive circuit 60 functions to supply an overshoot voltage $OSV_{T1}$ which is lower than the just overshoot voltage $JOSV_{T1}$ for that panel temperature $T_1$ when the target intermediate gray scale level is equal to or greater than a predetermined gray scale level, or supply the just overshoot voltage $JOSV_{T1}$ when the target intermediate gray scale level is higher than the predetermined gray scale level, thus providing a sufficient response speed while suppressing white shift.

The aforementioned predetermined gray scale level which serves as a border or threshold for determining whether to use a just parameter or a weaker OS parameter can be set in accordance with the value of the decay achievement ratio, desired response characteristics/display characteristics, and the like. For example, a "$64^{th}$/255 gray scale level" may be used as the border or threshold so that a weaker OS parameter is used for any gray scale level which is equal to or greater than this level and that a just parameter is used for any higher gray scale level. As used herein, the "$64^{th}$/255 gray scale level" is defined as, in the case where gray scale display is to be performed at $\gamma^{2.2}$, a gray scale level which renders the brightness $(64/255)^{2.2}$, assuming that the brightness in a black display state is "0" and that the brightness in a highest gray scale level displaying state is "1".

As has also been described with respect to the case where the decay achievement ratio is over 4% but 8% or less, a just parameter for a panel temperature $T_2$ which is higher than $T_1$ can be used as an OS parameter which is weaker than the just parameter for a panel temperature $T_1$. Preferably, the overshoot voltage $OSV_{T1}$ to be supplied by the drive circuit 60 when the target intermediate gray scale level is equal to or less than the predetermined border or threshold gray scale level is prescribed so that, even if the overshoot voltage $OSV_{T1}$ is supplied when a predetermined transmittance corresponding to the gray scale level displayed in a previous vertical scanning period is not reached, the transmittance after the lapse of a time corresponding to one vertical scanning period accounts for 70% to 100%, more preferably 75% to 100%, and still more preferably 80% to 100%, of the transmittance corresponding to the intermediate gray scale level. Similarly, by using a just parameter for a panel temperature $T_2$ which satisfies the relationship $T_1+3 \leqq T_2 < T_1+10$ (e.g., $T_1+5=T_2$), it becomes possible to enhance both effects of white shift suppression and response speed improvement.

In the case where the decay achievement ratio is 0.5% or less, as seen from Table 1, good results can be obtained by using the just parameter. This is presumably because, in the case where the decay achievement ratio is 0.5% or less, it is possible to substantially reach a target gray scale level within one vertical scanning period during a decay response, so that use of the just parameter does not result in the occurrence of white shift as illustrated in FIG. 11. Therefore, at a given panel temperature $T_1$ below 40° C., the drive circuit 60 functions to supply the just overshoot voltage $JOSV_{T1}$ for that panel temperature $T_1$, thus providing a sufficient response speed while preventing white shift.

As discussed above, according to the present invention, the decay achievement ratio is set at 8% or less. Hereinafter, a specific structure for realizing such a decay achievement ratio will be described. Note that a typical conventional alignment-divided vertical alignment type LCD employs a liquid crystal layer whose decay achievement ratio at a panel temperature of 5° C. is about 25% to 38%.

Figure 7:
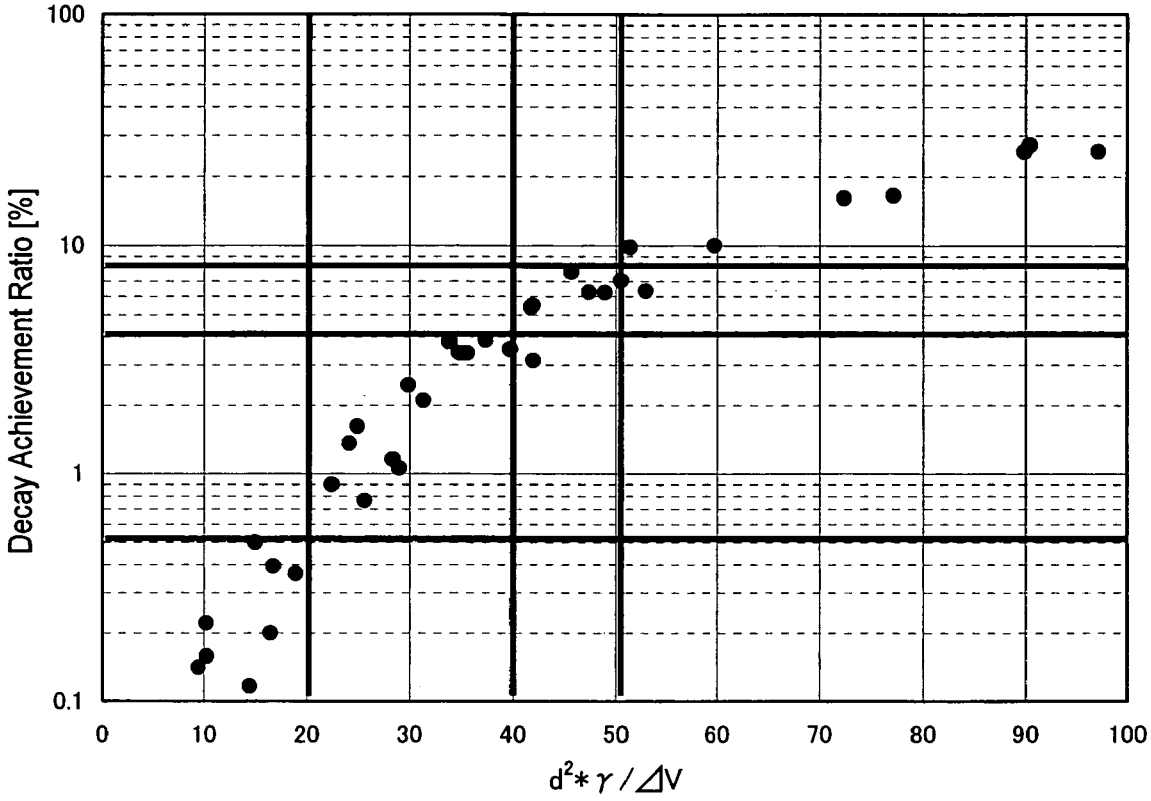
FIG. 7 is a graph showing a relationship between $d^2 \cdot \gamma/\Delta V$ ($mm^4/(V \cdot s)$) and a decay achievement ratio (%) in the case of 60 Hz driving.
Figure 8:
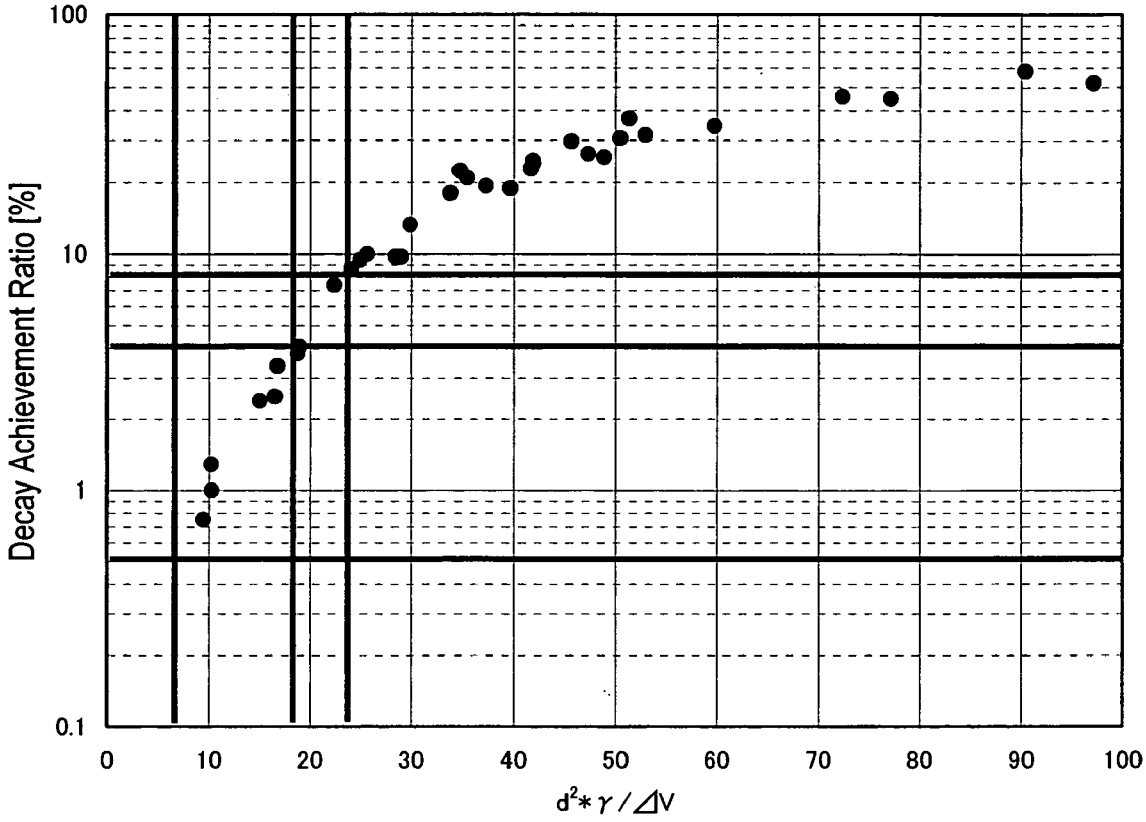
FIG. 8 is a graph showing a relationship between $d^2 \cdot \gamma/\Delta V$ ($mm^4/(V \cdot s)$) and a decay achievement ratio (%) in the case of 120 Hz driving.

Through a detailed study of the relationship between various cell parameters and decay achievement ratios, the inventors have experimentally found that there is a strong correlation between $d^2 \cdot \gamma/\Delta V (mm^4/(V \cdot s))$ and the decay achievement ratio, where $\gamma (mm^2/s)$ is a flow viscosity of the liquid crystal material composing the liquid crystal layer; d (μm) is a thickness of the liquid crystal layer; and ΔV (V) is the difference between an applied voltage across the liquid crystal layer in a highest gray scale level displaying state and an applied voltage across the liquid crystal layer in a black display state. FIGS. 7 and 8 show measurement results of the decay achievement ratio with respect to tentative LCDs of various cell parameters. FIG. 7 shows results concerning LCDs under 60 Hz driving (i.e., one vertical scanning period is about 16.7 msec). FIG. 8 shows results concerning LCDs under 120 Hz driving (i.e., one vertical scanning period is about 8.3 msec).

As can be seen from FIG. 7, in the case of 60 Hz driving, the decay achievement ratio can be kept over 4% and equal to or less than 8% by ensuring that $d^2 \cdot \gamma/\Delta V$ is greater than $40\times10^{-6}(mm^4/(V\cdot s))$ but equal to or less than $50\times10^{-6}(mm^4/(V\cdot s))$. Moreover, the decay achievement ratio can be kept over 0.5% and equal to or less than 4% by ensuring that $d^2 \cdot \gamma/\Delta V$ is greater than $20\times10^{-6}(mm^4/(V\cdot s))$ but equal to or less than $40\times10^{-6}(mm^4/(V\cdot s))$. Furthermore, the decay achievement ratio can be kept equal to or less than 0.5% by ensuring that $d^2 \cdot \gamma/\Delta V$ is equal to or less than $20\times10^{-6}(mm^4/(V\cdot s))$.

As can be seen from FIG. 8, in the case of 120 Hz driving, the decay achievement ratio can be kept over 4% and equal to or less than 8% by ensuring that $d^2 \cdot \gamma/\Delta V$ is greater than $18\times10^{-6}(mm^4/(V\cdot s))$ but equal to or less than $23\times10^{-6}(mm^4/(V\cdot s))$. Moreover, the decay achievement ratio can be kept over 0.5% and equal to or less than 4% by ensuring that $d^2 \cdot \gamma/\Delta V$ is greater than $7\times10^{-6}(mm^4/(V\cdot s))$ but equal to or less than $18\times10^{-6}(mm^4/(V\cdot s))$. Furthermore, the decay achievement ratio can be kept equal to or less than 0.5% by ensuring that $d^2 \cdot \gamma/\Delta V$ is equal to or less than $7\times10^{-6}(mm^4/(V\cdot s))$.

Next, more specific examples of OS parameters to be used for an LCD according to the present invention will be described. Table 2 shows OS parameters which were used for tentatively-produced LCD samples #1 to #3. Table 2 shows OS gray scale levels as starting from the $0^{th}$ gray scale level, rather than describing the entire OS parameter. Tables 3, 4, and 5 show just parameters for samples #1, #2, and #3, respectively. Table 6 shows Δn (anisotropy of refractive index) and Δϵ (anisotropy of dielectric constant) of a liquid crystal material composing the liquid crystal layer in samples #1 to #3. Table 7 shows approximate flow viscosity values $\gamma(mm^2/S)$ of the liquid crystal material.

TABLE 3-continued

| | Sample #1 | | | | | | | | |
|---|---|---|---|---|---|---|---|---|---|
| panel temperature | Just parameter (starting from $0^{th}$ gsl) | | | | | | | | |
| [° C.] | 0 | 32 | 64 | 96 | 128 | 160 | 192 | 224 | 255 |
| 25 | 0 | 55 | 103 | 136 | 162 | 189 | 217 | 242 | 255 |
| 30 | 0 | 51 | 96 | 132 | 160 | 188 | 216 | 241 | 255 |
| 35 | 0 | 48 | 90 | 127 | 158 | 187 | 216 | 241 | 255 |
| 40 | 0 | 44 | 83 | 123 | 156 | 186 | 215 | 240 | 255 |
| 45 | 0 | 41 | 76 | 120 | 154 | 186 | 215 | 240 | 255 |

TABLE 4

| | Sample #2 | | | | | | | | |
|---|---|---|---|---|---|---|---|---|---|
| panel temperature | Just parameter (starting from $0^{th}$ gsl) | | | | | | | | |
| [° C.] | 0 | 32 | 64 | 96 | 128 | 160 | 192 | 224 | 255 |
| 5 | 0 | 139 | 182 | 202 | 215 | 226 | 236 | 248 | 255 |
| 10 | 0 | 114 | 162 | 185 | 201 | 215 | 229 | 245 | 255 |
| 15 | 0 | 89 | 141 | 168 | 186 | 204 | 222 | 242 | 255 |
| 20 | 0 | 79 | 131 | 160 | 180 | 199 | 219 | 241 | 255 |
| 25 | 0 | 69 | 121 | 151 | 173 | 194 | 216 | 240 | 255 |
| 30 | 0 | 62 | 112 | 143 | 167 | 191 | 215 | 239 | 255 |
| 35 | 0 | 56 | 102 | 135 | 162 | 189 | 215 | 239 | 255 |
| 40 | 0 | 49 | 93 | 127 | 156 | 186 | 214 | 238 | 255 |
| 45 | 0 | 43 | 84 | 120 | 151 | 183 | 214 | 238 | 255 |

TABLE 2

| | LC layer thickness | panel temperature | decay achievement | rise achievement | OS | OS parameter (starting from $0^{th}$ gsl) | | | | | | | | |
|---|---|---|---|---|---|---|---|---|---|---|---|---|---|---|
| | [μm] | [° C.] | ratio [%] | ratio [%] | condition | 0 | 32 | 64 | 96 | 128 | 160 | 192 | 224 | 255 |
| Sample # 1 | 2.6 | 15 | 1.9 | 86.0 | 2 | 0 | 64 | 117 | 159 | 179 | 200 | 221 | 243 | 255 |
| | | 25 | 0.5 | 87.8 | 1 | 0 | 55 | 103 | 136 | 162 | 189 | 217 | 242 | 255 |
| | | 40 | 0.1 | 89.5 | 1 | 0 | 44 | 83 | 123 | 156 | 186 | 215 | 240 | 255 |
| Sample # 2 | 3.0 | 15 | 4.4 | 88.7 | 3 | 0 | 79 | 131 | 160 | 180 | 199 | 219 | 241 | 255 |
| | | 25 | 1.9 | 90.4 | 2 | 0 | 62 | 112 | 151 | 173 | 194 | 216 | 240 | 255 |
| | | 40 | 0.4 | 92.8 | 1 | 0 | 49 | 93 | 127 | 156 | 186 | 214 | 238 | 255 |
| Sample # 3 | 3.6 | 25 | 3.4 | 88.6 | 3 | 0 | 89 | 144 | 170 | 187 | 203 | 221 | 240 | 255 |
| | | 40 | 0.9 | 91.6 | 2 | 0 | 65 | 113 | 151 | 171 | 191 | 214 | 238 | 255 |

TABLE 3

| | Sample #1 | | | | | | | | |
|---|---|---|---|---|---|---|---|---|---|
| panel temperature | Just parameter (starting from $0^{th}$ gsl) | | | | | | | | |
| [° C.] | 0 | 32 | 64 | 96 | 128 | 160 | 192 | 224 | 255 |
| 5 | 0 | 108 | 166 | 189 | 205 | 218 | 231 | 247 | 255 |
| 10 | 0 | 91 | 148 | 174 | 192 | 209 | 226 | 245 | 255 |
| 15 | 0 | 73 | 130 | 159 | 179 | 200 | 221 | 243 | 255 |
| 20 | 0 | 64 | 117 | 148 | 171 | 195 | 219 | 243 | 255 |

TABLE 5

| | Sample #3 | | | | | | | | |
|---|---|---|---|---|---|---|---|---|---|
| panel temperature | Just parameter (starting from $0^{th}$ gsl) | | | | | | | | |
| [° C.] | 0 | 32 | 64 | 96 | 128 | 160 | 192 | 224 | 255 |
| 5 | 0 | 179 | 216 | 231 | 239 | 246 | 255 | 255 | 255 |
| 10 | 0 | 160 | 202 | 219 | 229 | 238 | 247 | 252 | 255 |
| 15 | 0 | 140 | 187 | 207 | 219 | 229 | 238 | 249 | 255 |
| 20 | 0 | 119 | 171 | 193 | 207 | 219 | 231 | 245 | 255 |

TABLE 5-continued

| panel temperature [° C.] | Sample #3 Just parameter (starting from 0th gsl) 0 | 32 | 64 | 96 | 128 | 160 | 192 | 224 | 255 |
|---|---|---|---|---|---|---|---|---|---|
| 25 | 0 | 97 | 154 | 179 | 195 | 209 | 224 | 241 | 255 |
| 30 | 0 | 89 | 144 | 170 | 187 | 203 | 221 | 240 | 255 |
| 35 | 0 | 81 | 133 | 160 | 179 | 197 | 217 | 239 | 255 |
| 40 | 0 | 73 | 123 | 151 | 171 | 191 | 214 | 238 | 255 |
| 45 | 0 | 65 | 113 | 143 | 163 | 186 | 211 | 237 | 255 |

TABLE 6

| | $\Delta n$ | $\Delta\epsilon$ |
|---|---|---|
| Sample # 1 | 0.116 | −3.2 |
| Sample # 2 | 0.096 | −3.3 |
| Sample # 3 | 0.078 | −3.2 |

TABLE 7

| | 15° C. | 25° C. | 40° C. |
|---|---|---|---|
| flow viscosity [mm2/s] | about 24 | about 15 | about 9 |

As can be seen from a comparison between Table 2 and Table 3, in the case where the rise achievement ratio was equal to or greater than 75% and the decay achievement ratio was equal to or less than 0.5% (OS condition 1 in Table 2), a just parameter for each given panel temperature was used as an OS parameter. In the case where the rise achievement ratio was equal to or greater than 75% and the decay achievement ratio was greater than 0.5% but equal to or less than 4% (OS condition 2 in Table 2), the just parameter was used for any gray scale level higher than the $64^{th}$ gray scale level, and the +5° C. just parameter was used for the $64^{th}$ and lower gray scale levels, as an OS parameter. In the case where the rise achievement ratio was equal to or greater than 75% and the decay achievement ratio was greater than 4% but equal to or less than 8% (OS condition 3 in Table 2), the +5° C. just parameter was used as an OS parameter for all gray scale levels. By using the OS parameters shown in Table 2, all of the tentatively-produced samples #1 to #3 realized good moving picture display.

Although the above embodiment illustrates examples of the present invention which are directed to the aforementioned MVA-type LCD, the present invention is also applicable to any other alignment-divided vertical alignment type LCD, and similar effects can be obtained therefrom, since the decay response characteristics of a liquid crystal layer are not determined by the particular technique of alignment division, but are determined by the type of liquid crystal material, the thickness (cell thickness) of the liquid crystal layer, and applied voltages. For example, the present invention is also applicable to an LCD of a CPA (Continuous Pinwheel Alignment) type.

Figure 9:
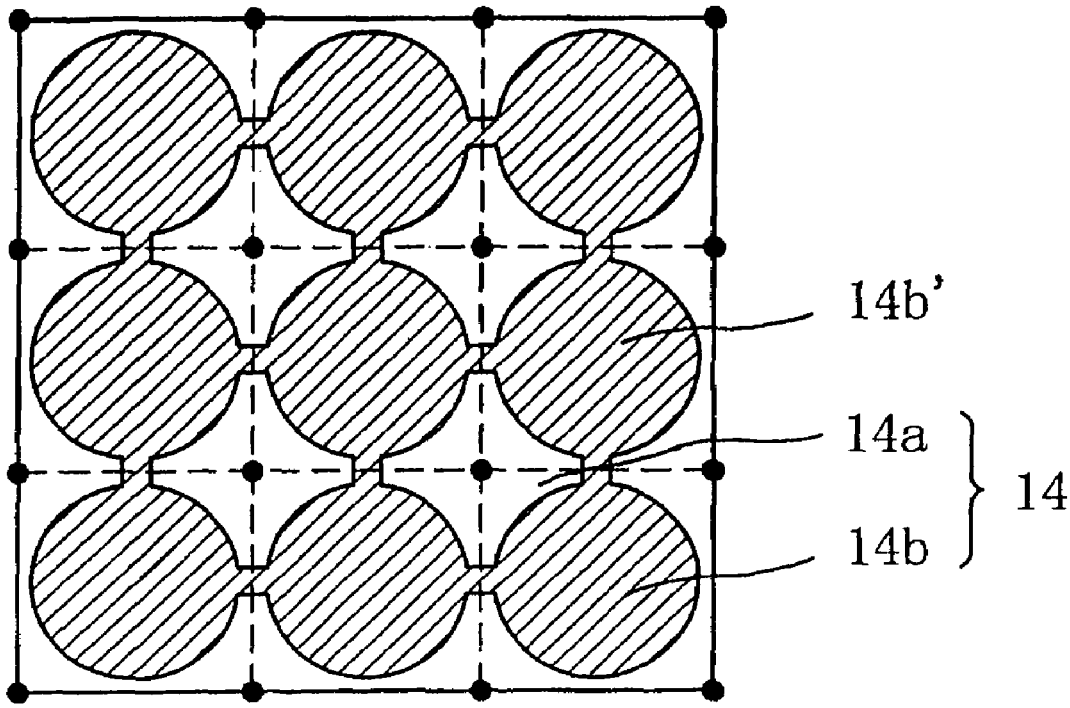
FIG. 9 is an upper plan view schematically showing a pixel electrode comprised in a CPA-type LCD.

FIG. 9 shows an exemplary pixel electrode 14 comprised in a CPA-type LCD. This pixel electrode 14 includes: a plurality of openings 14*a* (i.e., portions of the pixel electrode 14 in which the conductive film has been removed); and a solid portion 14*b* (i.e., a portion in which the conductive film is present; that is, any portion other than the openings 14*a*).

The plurality of openings 14*a* are disposed so that their centers form a square-shaped lattice, in which four lattice points form a single unit cell. The solid portion 14*b* comprises a plurality of generally circular solid subportions (referred to as "unit solid portions") 14*b*'. Each unit solid portion 14*b*' is surrounded by four openings 14*a* whose centers are on the four lattice points forming a single unit cell. Each opening 14*a* has a general star shape, whose sides (edges) correspond to four quadrants of a circle, with a four-fold rotation axis in the middle.

In an LCD having such pixel electrodes 14, under an applied voltage, a plurality of liquid crystal domains are formed, each of which takes a radially-inclined orientation state due to oblique electric fields which are formed along the edges of an opening 14*a*.

Now, an orientation state of liquid crystal molecules 13*a* in the LCD comprising the pixel electrodes 14 as shown in FIG. 9 are described with reference to FIGS. 10A to 10C.

Figure 10A:
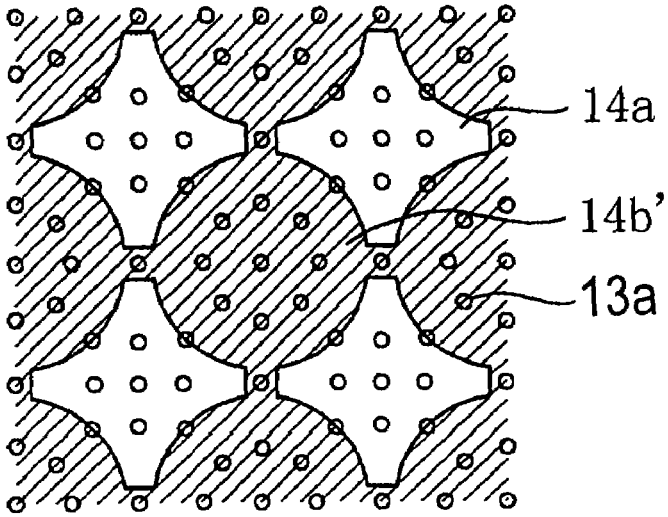
FIGS. 10A to 10C are upper plan views schematically showing an orientation state of liquid crystal molecules in a CPA-type LCD.
Figure 10B:
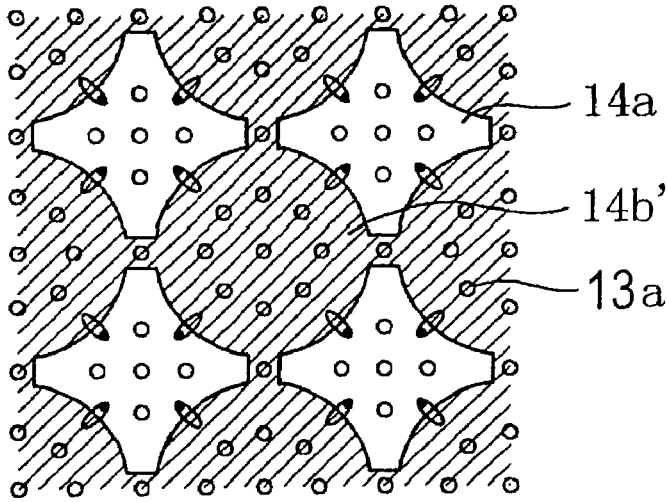
Figure 10C:
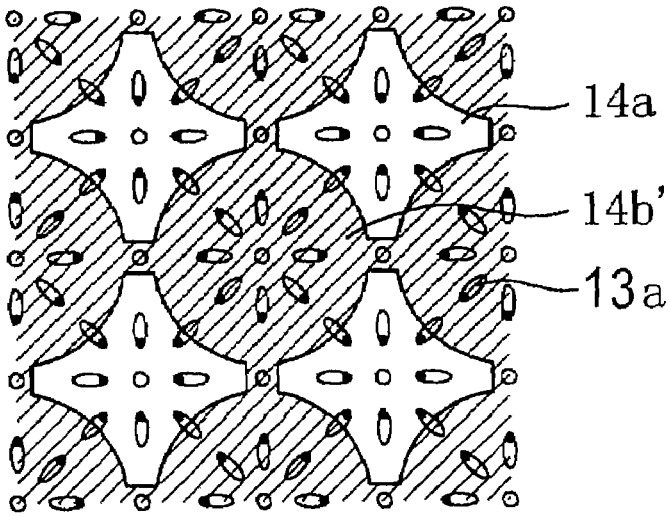

FIGS. 10A to 10C schematically show an orientation state of the liquid crystal molecules 13*a* as observed in a substrate normal direction. FIGS. 10B and 10C, where an orientation state of the liquid crystal molecules 13*a* as observed in the substrate normal direction is shown, depict some of the liquid crystal molecules 13*a* as ellipsoids each having a darkened end. This indicates that each such liquid crystal molecule 13*a* is slanted so that the darkened end lies closer (than is the other end) to the substrate bearing the pixel electrodes 14 having the openings 14*a*. Herein, one of the unit cells (defined by four openings 14*a*) in the pixel region shown in FIG. 9 will be described.

In a state where no voltage is applied across the liquid crystal layer 13*a*, the orientation direction of the liquid crystal molecules 13*a* is restricted by a vertical alignment layer (not shown) which is provided on a face of each of a pair of substrates facing the liquid crystal layer, so that they are vertically aligned as show in FIG. 10A.

When an electric field is applied across the liquid crystal layer, causing an oblique electric field to be generated at the edges of each opening 14*a*, the liquid crystal molecules 13*a* will slant beginning from the edges of each opening 14*a*, as shown in FIG. 10B. Surrounding liquid crystal molecules 13*a* will also slant so as to match the orientations of the slanted liquid crystal molecules 13*a* at the edges of the opening 14*a*, until the axial orientations of the liquid crystal molecules 13*a* become stabilized as shown in FIG. 10C (radially-inclined orientation). One such liquid crystal domain taking a radially-inclined orientation state is formed in a region corresponding to each opening 14*a*, and also in a region corresponding to the solid portion 14*b*' within each unit cell.

Thus, in the case of a CPA-type LCD, a vertical alignment type liquid crystal layer is gradually divided between different orientation directions, around each central liquid crystal molecule 13*a* which remains vertically aligned near the center of each opening 14*a* or unit solid portion 14*b*'. In a CPA-type LCD, too, it is possible to display high-quality moving pictures by varying the OS parameter setting in accordance with the decay achievement ratio in the aforementioned manner.

According to the present invention, an alignment-divided vertical alignment type liquid crystal display device which is capable of displaying high-quality moving pictures, a driving method thereof, and an electronic device incorporating such a liquid crystal display device are provided. A liquid crystal display device according to the present invention may be suitably used for, for example, a liquid crystal television set having circuitry for receiving television broadcasts. Moreover, a liquid crystal display device according to the present invention may be suitably used for any electronic device, such as a personal computer or a PDA, that is used for the purpose of displaying moving pictures.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This non-provisional application claims priority under 35 USC §119(a) on Patent Application No. 2004-080338 filed in Japan on Mar. 19, 2004, the entire contents of which are hereby incorporated by reference.

What is claimed is:

1. A liquid crystal display device for performing display in a normally black mode, comprising: a liquid crystal panel including a plurality of pixels, each having a first electrode, a second electrode opposing the first electrode, and a vertical alignment type liquid crystal layer provided between the first electrode and the second electrode; and a drive circuit for supplying a driving voltage to the liquid crystal panel, wherein, the drive circuit is capable of, when displaying an intermediate gray scale level which is higher than a gray scale level displayed in a previous vertical scanning period, supplying to the liquid crystal panel an overshoot voltage OSV which is higher than a predetermined gray scale voltage corresponding to the intermediate gray scale level, and a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., the decay transmittance Td is greater than 4% and equal to or less than 8% of the transmittance in the highest gray scale level displaying state, and when displaying an intermediate gray scale level which is higher than a gray scale level displayed in a previous vertical scanning period, the drive circuit supplies an overshoot voltage $OSV_{T1}$ which is lower than a just overshoot voltage $JOSV_{T1}$ for the panel temperature $T_1$.

2. The liquid crystal display device of claim 1, wherein the overshoot voltage $OSV_{T1}$ to be supplied by the drive circuit at the panel temperature $T_1$ is equal to a just overshoot voltage $JOSV_{T2}$ for a panel temperature $T_2$ which is higher than the panel temperature $T_1$.

3. The liquid crystal display device of claim 2, wherein the panel temperature $T_2$ and the panel temperature $T_1$ satisfy the relationship $T_1+3 \leqq T_2 < T_1+10$.

4. The liquid crystal display device of claim 3, wherein the panel temperature $T_2$ and the panel temperature $T_1$ substantially satisfy the relationship $T_1+5=T_2$.

5. The liquid crystal display device of claim 1, wherein the overshoot voltage $OSV_{T1}$ to be supplied by the drive circuit at the panel temperature $T_1$ is prescribed so that, even if the overshoot voltage $OSV_{T1}$ is supplied when a predetermined transmittance corresponding to the gray scale level displayed in the previous vertical scanning period is not reached, the transmittance after the lapse of the time corresponding to one vertical scanning period accounts for 70% to 100% of the transmittance corresponding to the intermediate gray scale level.

6. The liquid crystal display device of claim 1, wherein $d^2 \cdot \gamma/\Delta V$ is prescribed to be greater than $40\times10^{-6}(mm^4/(V\cdot s))$ and equal to or less than $50\times10^{-6}(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

7. The liquid crystal display device of claim 1, wherein $d^2 \cdot \gamma/\Delta V$ is prescribed to be greater than $18\times10^{-6}(mm^4/(V\cdot s))$ and equal to or less than $23\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

8. The liquid crystal display device of claim 1, wherein at a panel temperature $T_3$ which is below 40° C. and higher than the panel temperature $T_1$, the decay transmittance Td is greater than 0.5% and equal to or less than 4% of the transmittance in the highest gray scale level displaying state, and when displaying an intermediate gray scale level which is higher than a gray scale level displayed in a previous vertical scanning period, the drive circuit supplies an overshoot voltage $OSV_{T3}$ which is lower than a just overshoot voltage $JOSV_{T3}$ for the panel temperature $T_3$ if the intermediate gray scale level is equal to or less than a predetermined gray scale level, and supplies the just overshoot voltage $JOSV_{T3}$ if the intermediate gray scale level is higher than the predetermined gray scale level.

9. The liquid crystal display device of claim 8, wherein the predetermined gray scale level is a gray scale level equal to or less than a $64^{th}/255$ gray scale level.

10. The liquid crystal display device of claim 8, wherein the overshoot voltage $OSV_{T3}$ to be supplied by the drive circuit at the panel temperature $T_3$ is equal to a just overshoot voltage $JOSV_{T4}$ for a panel temperature $T_4$ which is higher than the panel temperature $T_3$.

11. The liquid crystal display device of claim 10, wherein the panel temperature $T_4$ and the panel temperature $T_3$ satisfy the relationship $T_3+3 \leqq T_4 < T_3+10$.

12. The liquid crystal display device of claim 11, wherein the panel temperature $T_4$ and the panel temperature $T_3$ substantially satisfy the relationship $T_3+5=T_4$.

13. The liquid crystal display device of claim 8, wherein the overshoot voltage $OSV_{T3}$ to be supplied by the drive circuit at the panel temperature $T_3$ is prescribed so that, even if the overshoot voltage $OSV_{T3}$ is supplied when a predetermined transmittance corresponding to the gray scale level displayed in the previous vertical scanning period is not reached, the transmittance after the lapse of the time corresponding to one vertical scanning period accounts for 70% to 100% of the transmittance corresponding to the intermediate gray scale level.

14. The liquid crystal display device of claim 8, wherein $d^2 \cdot \gamma/\Delta V$ is prescribed to be greater than $20\times10^{-6}(mm^4/(V\cdot s))$ and equal to or less than $40\times10^{-6}(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

15. The liquid crystal display device of claim 8, wherein $d^2 \cdot \gamma/\Delta V$ is prescribed to be greater than $7\times10^{-6}(mm^4/(V\cdot s))$ and equal to or less than $18\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

16. The liquid crystal display device of claim 8, wherein at a panel temperature $T_5$ which is below 40° C. and higher than the panel temperature $T_3$, the decay transmittance Td is less than 0.5% of the transmittance in the highest gray scale level displaying state, and when displaying an intermediate gray scale level which is higher than a gray scale level displayed in a previous vertical scanning period, the drive circuit supplies a just overshoot voltage $JOSV_{T5}$ for the panel temperature $T_5$.

17. The liquid crystal display device of claim 16, wherein $d^2 \cdot \gamma/\Delta V$ is prescribed to be equal to or less than $20\times10^{-6}$ $(mm^4/(V\cdot s))$ under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

18. The liquid crystal display device of claim 16, wherein $d^2 \cdot \gamma/\Delta V$ is prescribed to be equal to or less than $7\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

19. An electronic device comprising the liquid crystal display device of claim 1.

20. The electronic device of claim 19, further comprising circuitry for receiving television broadcasts.

21. A liquid crystal display device for performing display in a normally black mode, comprising: a liquid crystal panel including a plurality of pixels, each having a first electrode, a second electrode opposing the first electrode, and a vertical alignment type liquid crystal layer provided between the first electrode and the second electrode; and a drive circuit for supplying a driving voltage to the liquid crystal panel, wherein, the drive circuit is capable of, when displaying an intermediate gray scale level which is higher than a gray scale level displayed in a previous vertical scanning period, supplying to the liquid crystal panel an overshoot voltage OSV which is higher than a predetermined gray scale voltage corresponding to the intermediate gray scale level, and a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., the decay transmittance Td is greater than 0.5% and equal to or less than 4% of the transmittance in the highest gray scale level displaying state, and when displaying an intermediate gray scale level which is higher than a gray scale level displayed in a previous vertical scanning period, the drive circuit supplies an overshoot voltage $OSV_{T1}$ which is lower than a just overshoot voltage $JOSV_{T1}$ for the panel temperature $T_1$ if the intermediate gray scale level is equal to or less than a predetermined gray scale level, and supplies the just overshoot voltage $JOSV_{T1}$ if the intermediate gray scale level is higher than the predetermined gray scale level.

22. The liquid crystal display device of claim 21, wherein the predetermined gray scale level is a gray scale level equal to or less than a $64^{th}/255$ gray scale level.

23. The liquid crystal display device of claim 21, wherein the overshoot voltage $OSV_{T1}$ to be supplied by the drive circuit at the panel temperature $T_1$ is prescribed so that, even if the overshoot voltage $OSV_{T1}$ is supplied when a predetermined transmittance corresponding to the gray scale level displayed in the previous vertical scanning period is not reached, the transmittance after the lapse of the time corresponding to one vertical scanning period accounts for 70% to 100% of the transmittance corresponding to the intermediate gray scale level.

24. The liquid crystal display device of claim 21, wherein the overshoot voltage $OSV_{T1}$ to be supplied by the drive circuit at the panel temperature $T_1$ is equal to a just overshoot voltage $JOSV_{T2}$ for a panel temperature $T_2$ which is higher than the panel temperature $T_1$.

25. The liquid crystal display device of claim 24, wherein the panel temperature $T_2$ and the panel temperature $T_1$ satisfy the relationship $T_1+3 \leqq T_2 < T_1+10$.

26. The liquid crystal display device of claim 25, wherein the panel temperature $T_2$ and the panel temperature $T_1$ substantially satisfy the relationship $T_1+5=T_2$.

27. The liquid crystal display device of claim 21, wherein $d^2 \cdot \gamma/\Delta V$ is prescribed to be greater than $20\times10^{-6}(mm^4/(V\cdot s))$ and equal to or less than $40\times10^{-6}(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

28. The liquid crystal display device of claim 21, wherein $d^2 \cdot \gamma/\Delta V$ is prescribed to be greater than $7\times10^{-6}(mm^4/(V\cdot s))$ and equal to or less than $18\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

29. The liquid crystal display device of claim 21, wherein at a panel temperature $T_3$ which is below 40° C. and higher than the panel temperature $T_1$, the decay transmittance Td is less than 0.5% of the transmittance in the highest gray scale level displaying state, and when displaying an intermediate gray scale level which is higher than a gray scale level displayed in a previous vertical scanning period, the drive circuit supplies a just overshoot voltage $JOSV_{T3}$ for the panel temperature $T_3$.

30. The liquid crystal display device of claim 29, wherein $d^2 \cdot \gamma/\Delta V$ is prescribed to be equal to or less than $20\times10^{-6}$ $(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

31. The liquid crystal display device of claim 29, wherein $d^2 \cdot \gamma/\Delta V$ is prescribed to be equal to or less than $7\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

32. An electronic device comprising the liquid crystal display device of claim 21.

33. The electronic device of claim 32, further comprising circuitry for receiving television broadcasts.

34. A liquid crystal display device for performing display in a normally black mode, comprising: a liquid crystal panel including a plurality of pixels, each having a first electrode, a second electrode opposing the first electrode, and a vertical alignment type liquid crystal layer provided between the first electrode and the second electrode; and a drive circuit for supplying a driving voltage to the liquid crystal panel, wherein, the drive circuit is capable of, when displaying an intermediate gray scale level which is higher than a gray scale level displayed in a previous vertical scanning period, supplying to the liquid crystal panel an overshoot voltage OSV which is higher than a predetermined gray scale voltage corresponding to the intermediate gray scale level, and a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., the decay transmittance Td is equal to or less than 0.5% of the transmittance in the highest gray scale level displaying state, and when displaying an intermediate gray scale level which is higher than a gray scale level displayed in a previous vertical scanning period, the drive circuit supplies a just overshoot voltage $JOSV_{T1}$ for the panel temperature $T_1$.

35. The liquid crystal display device of claim 34, wherein $d^2 \cdot \gamma/\Delta V$ is prescribed to be equal to or less than $20\times10^{-6}$ $(mm^4/(V\cdot s))$, under the conditions that one vertical scanning period is about 16.7 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

36. The liquid crystal display device of claim 34, wherein $d^2 \cdot \gamma/\Delta V$ is prescribed to be equal to or less than $7\times10^{-6}(mm^4/(V\cdot s))$, under the conditions that one vertical scanning period is about 8.3 msec; a liquid crystal material composing the liquid crystal layer has a flow viscosity $\gamma(mm^2/s)$; the liquid crystal layer has a thickness d(μm); and an applied voltage across the liquid crystal layer in the highest gray scale level displaying state and an applied voltage across the liquid crystal layer in the black display state have a difference ΔV(V).

37. An electronic device comprising the liquid crystal display device of claim 34.

38. The electronic device of claim 37, further comprising circuitry for receiving television broadcasts.

39. A method of driving a liquid crystal display device for performing display in a normally black mode, the liquid crystal display device including a plurality of pixels each having a first electrode, a second electrode opposing the first electrode, and a vertical alignment type liquid crystal layer provided between the first electrode and the second electrode, wherein a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, the driving method comprising:

an OSV applying step of, when displaying an intermediate gray scale level which is higher than a gray scale level displayed in a previous vertical scanning period, applying an overshoot voltage OSV which is higher than a predetermined gray scale voltage corresponding to the intermediate gray scale level, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., if the decay transmittance Td is greater than 4% and equal to or less than 8% of the transmittance in the highest gray scale level displaying state, an overshoot voltage $OSV_{T1}$ which is lower than a just overshoot voltage $JOSV_{T1}$ for the panel temperature $T_1$ is applied in the OSV applying step.

40. The liquid crystal display device driving method of claim 39, wherein at a panel temperature $T_2$ which is below 40° C. and higher than the panel temperature $T_1$, if the decay transmittance Td is greater than 0.5% and equal to or less than 4% of the transmittance in the highest gray scale level displaying state, an overshoot voltage $OSV_{T2}$ which is lower than a just overshoot voltage $JOSV_{T2}$ for the panel temperature $T_2$ is applied in the OSV applying step if the intermediate gray scale level is equal to or less than a predetermined gray scale level, and the just overshoot voltage $JOSV_{T2}$ is applied in the OSV applying step if the intermediate gray scale level is higher than the predetermined gray scale level.

41. The liquid crystal display device driving method of claim 40, wherein at a panel temperature. $T_3$ which is below 40° C. and higher than the panel temperature $T_2$, if the decay transmittance Td is less than 0.5% of the transmittance in the highest gray scale level displaying state, a just overshoot voltage $JOSV_{T3}$ for the panel temperature $T_3$ is applied in the OSV applying step.

42. A method of driving a liquid crystal display device for performing display in a normally black mode, the liquid crystal display device including a plurality of pixels each having a first electrode, a second electrode opposing the first electrode, and a vertical alignment type liquid crystal layer provided between the first electrode and the second electrode, wherein a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, the driving method comprising:

an OSV applying step of, when displaying an intermediate gray scale level which is higher than a gray scale level displayed in a previous vertical scanning period, applying an overshoot voltage OSV which is higher than a predetermined gray scale voltage corresponding to the intermediate gray scale level, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., if the decay transmittance Td is greater than 0.5% and equal to or less than 4% of the transmittance in the highest gray scale level displaying state, an overshoot voltage $OSV_{T1}$ which is lower than a just overshoot voltage $JOSV_{T1}$ for the panel temperature $T_1$ is applied in the OSV applying step if the intermediate gray scale level is equal to or less than a predetermined gray scale level, and the just overshoot voltage $JOSV_{T1}$ is applied in the OSV applying step if the intermediate gray scale level is higher than the predetermined gray scale level.

43. The liquid crystal display device driving method of claim 42, wherein at a panel temperature $T_2$ which is below 40° C. and higher than the panel temperature $T_1$, if the decay transmittance Td is less than 0.5% of the transmittance in the highest gray scale level displaying state, a just overshoot voltage $JOSV_{T2}$ for the panel temperature $T_2$ is applied in the OSV applying step.

44. A method of driving a liquid crystal display device for performing display in a normally black mode, the liquid crystal display device including a plurality of pixels each having a first electrode, a second electrode opposing the first electrode, and a vertical alignment type liquid crystal layer provided between the first electrode and the second electrode, wherein a rise transmittance Tr, defined as the transmittance when a time corresponding to one vertical scanning period has elapsed since a voltage corresponding to a highest gray scale level is applied in a black display state, and a decay transmittance Td, defined as the transmittance when a time corresponding to one vertical scanning period has elapsed since a voltage corresponding to a black display state is applied in a highest gray scale level displaying state, are prescribed so that: at least at a panel temperature of 40° C., the rise transmittance Tr is equal to or greater than 75% of the transmittance in the highest gray scale level displaying state, and the decay transmittance Td is equal to or less than 8% of the transmittance in the highest gray scale level displaying state, the driving method comprising:

an OSV applying step of, when displaying an intermediate gray scale level which is higher than a gray scale level displayed in a previous vertical scanning period, applying an overshoot voltage OSV which is higher than a predetermined gray scale voltage corresponding to the intermediate gray scale level, wherein, given that a just overshoot voltage $JOSV_T$ is defined as an overshoot voltage which causes, at a panel temperature T(° C.), the transmittance to reach a predetermined transmittance corresponding to the intermediate gray scale level within a time corresponding to one vertical scanning period, at a panel temperature $T_1$ below 40° C., if the decay transmittance Td is equal to or less than 0.5% of the transmittance in the highest gray scale level displaying state, a just overshoot voltage $JOSV_{T1}$ for the panel temperature $T_1$ is applied in the OSV applying step.

* * * * *